US011818822B2

(12) United States Patent
Pandit et al.

(10) Patent No.: US 11,818,822 B2
(45) Date of Patent: Nov. 14, 2023

(54) DIMMERS WITH AN ACTUATOR FOR SWITCHING DIMMER MODE

(71) Applicant: EATON INTELLIGENT POWER LIMITED, Dublin (IE)

(72) Inventors: Gayatri Pandit, Pune (IN); Swapnil Suresh Sabde, Pune (IN); Hoon Lee, Sugar Hill, GA (US); Saivaraprasad Murahari, Peachtree City, GA (US); Rahul Sakhare, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/717,437

(22) Filed: Apr. 11, 2022

(65) Prior Publication Data

US 2022/0338330 A1 Oct. 20, 2022

Related U.S. Application Data

(60) Provisional application No. 63/174,652, filed on Apr. 14, 2021.

(51) Int. Cl.
*H05B 47/185* (2020.01)

(52) U.S. Cl.
CPC ..... *H05B 47/185* (2020.01)

(58) Field of Classification Search
CPC ..... H05B 47/185; H05B 47/17
See application file for complete search history.

(56) References Cited

U.S. PATENT DOCUMENTS

| | | | | |
|---|---|---|---|---|
| 8,492,996 | B2 | 7/2013 | Gehman | |
| 8,963,440 | B2 | 2/2015 | Jennings et al. | |
| 2014/0252980 | A1* | 9/2014 | Salvestrini | H05B 47/10 315/246 |
| 2018/0092174 | A1* | 3/2018 | Mosebrook | H05B 47/175 |
| 2020/0152403 | A1* | 5/2020 | Shi | F21V 23/0435 |

* cited by examiner

*Primary Examiner* — Minh D A
(74) *Attorney, Agent, or Firm* — Eckert Seamans Cherin & Mellott, LLC

(57) ABSTRACT

A dimmer includes a primary intensity actuator coupled to a primary intensity potentiometer, the primary intensity actuator structured to be actuated for at least one of: controlling an amount of power delivered to a load connected to the dimmer in normal operation mode, and adjusting light intensity based on a first user input in the normal operation mode; selecting a type of end trimming based on a second user input before entering configuration mode; or adjusting, based on a third user input, an end trim value; a configuration actuator arranged on a side of the dimmer and structured to be actuated for entering the configuration mode based on a fourth user input within a first predetermined period; and a controller coupled to the primary intensity potentiometer, the configuration actuator, and a driver circuit coupled to a bidirectional switching device, the controller structured to control dimmer operation.

23 Claims, 21 Drawing Sheets

DIMMERS WITH AN ACTUATOR FOR SWITCHING DIMMER MODE

CROSS-REFERENCE TO RELATED APPLICATION

This patent application claims the priority benefit under 35 U.S.C. § 119(e) of U.S. Provisional Application No. 63/174,652, filed on Apr. 14, 2021, the contents of which are herein incorporated by reference.

BACKGROUND OF THE INVENTION

Field of the Invention

The disclosed concept relates generally to dimmers for use with a load, and in particular, to dimmers having capabilities to adjust end trim values. The disclosed concept also relates to dimmer systems.

Background Information

Dimmers provide a dimming function for loads such as lights. Dimmers are generally placed between a power source and the load and control the nature of the power provided to the load. Very simple dimmers regulate the voltage provided to the load by, for example, dividing the voltage using a variable resistor. More recent dimmers cut off a part of each half-cycle of the power provided to the load. In some dimmers, the cut off is from a zero crossing in the power until a predetermined time after the zero crossing. Increasing the predetermined amount of time increases the amount of dimming. Cutting off a part of the waveform can be accomplished using a circuit component such as a TRIAC (triode for alternating current). The dimmers typically use a potentiometer coupled to an intensity actuator (e.g., a main slider of the dimmers) for adjusting intensity of light. Some two-wire dimmers use an additional potentiometer for adjusting a low-end trimming value (i.e., low-end or minimum light intensity levels). However, the two-wire dimmers with the additional potentiometer do not provide high-end trimming. Further, the two-wire dimmers use the primary actuator to control the change of the amount of power delivery to the load and use the secondary actuator only for adjusting trimming end values. Additionally, controllers of the two-wire dimmer have to continuously monitor the voltage from the secondary actuator that is coupled to the secondary potentiometer which determines the minimum intensity, as well as the primary actuator input (main slider) that is connected to the primary potentiometer.

There is room for improvement in dimmers.

SUMMARY OF THE INVENTION

These needs, and others, are met by at least one embodiment of the disclosed concept in which a dimmer includes a primary intensity actuator coupled to a primary intensity potentiometer, the primary intensity actuator structured to be actuated for at least one of: controlling an amount of power delivered to a load connected to the dimmer between minimum amount and maximum amount of power in normal operation mode, and adjusting light intensity based on a first user input in the normal operation mode; selecting a type of end trimming based on a second user input before entering configuration mode; or adjusting, based on a third user input, an end trim value during the configuration mode; a configuration actuator structured to be actuated for entering the configuration mode based on a fourth user input within a first predetermined period; and a controller coupled to the primary intensity potentiometer, the configuration actuator, and a driver circuit coupled to a bidirectional switching device, the controller structured to control dimmer operation, comprising receiving a voltage signal based on variable resistance from the primary intensity potentiometer, receiving a mode selection signal from the configuration actuator, and transmitting a dimming signal to the driver circuit for driving the bidirectional switching device, the dimming signal based at least in part on the voltage signal.

In accordance with an example embodiment of the disclosed concept, a dimmer system including a load, a hot conductor electrically coupled to a power source, a load conductor electrically coupled to the load; and a dimmer electrically coupled to the hot conductor and the load conductor. The dimmer includes: a primary intensity actuator coupled to a primary intensity potentiometer, the primary intensity actuator structured to be actuated for at least one of: controlling an amount of power delivered to a load connected to the dimmer between minimum amount and maximum amount of power in normal operation mode, and adjusting light intensity based on a first user input in the normal operation mode; selecting a type of end trimming based on a second user input before entering configuration mode; or adjusting, based on a third user input, an end trim value during the configuration mode; a configuration actuator arranged on a side of the dimmer and structured to be actuated for entering the configuration mode based on a fourth user input within a first predetermined period; and a controller coupled to the primary intensity potentiometer, the configuration actuator, and a driver circuit coupled to a bidirectional switching device, the controller structured to control dimmer operation, comprising receiving a voltage signal based on variable resistance from the primary intensity potentiometer, receiving a mode selection signal from the configuration actuator, and transmitting a dimming signal to the driver circuit for driving the bidirectional switching device, the dimming signal based at least in part on the voltage signal.

In accordance with an example embodiment of the disclosed concept, a method for adjusting an end trim value includes: determining whether a first user input requesting for configuration mode is detected, the first user input comprising a first actuation of a primary intensity actuator coupled to a primary intensity potentiometer within the dimmer and a second actuation of a configuration actuator of the dimmer; and based on a determination that the first user input is detected, entering the configuration mode, adjusting an end trim value based on a second user input comprising a third actuation of the primary intensity actuator, storing a new end trim value selected by the user, exiting the configuration mode; and operating the dimmer based at least in part on the new end trim value in a normal operation mode, or based on a determination that the first user input requesting for the configuration mode is not detected, operating the dimmer in the normal operation mode based on maximum light intensity, minimum light intensity, or a previously determined end trim value.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
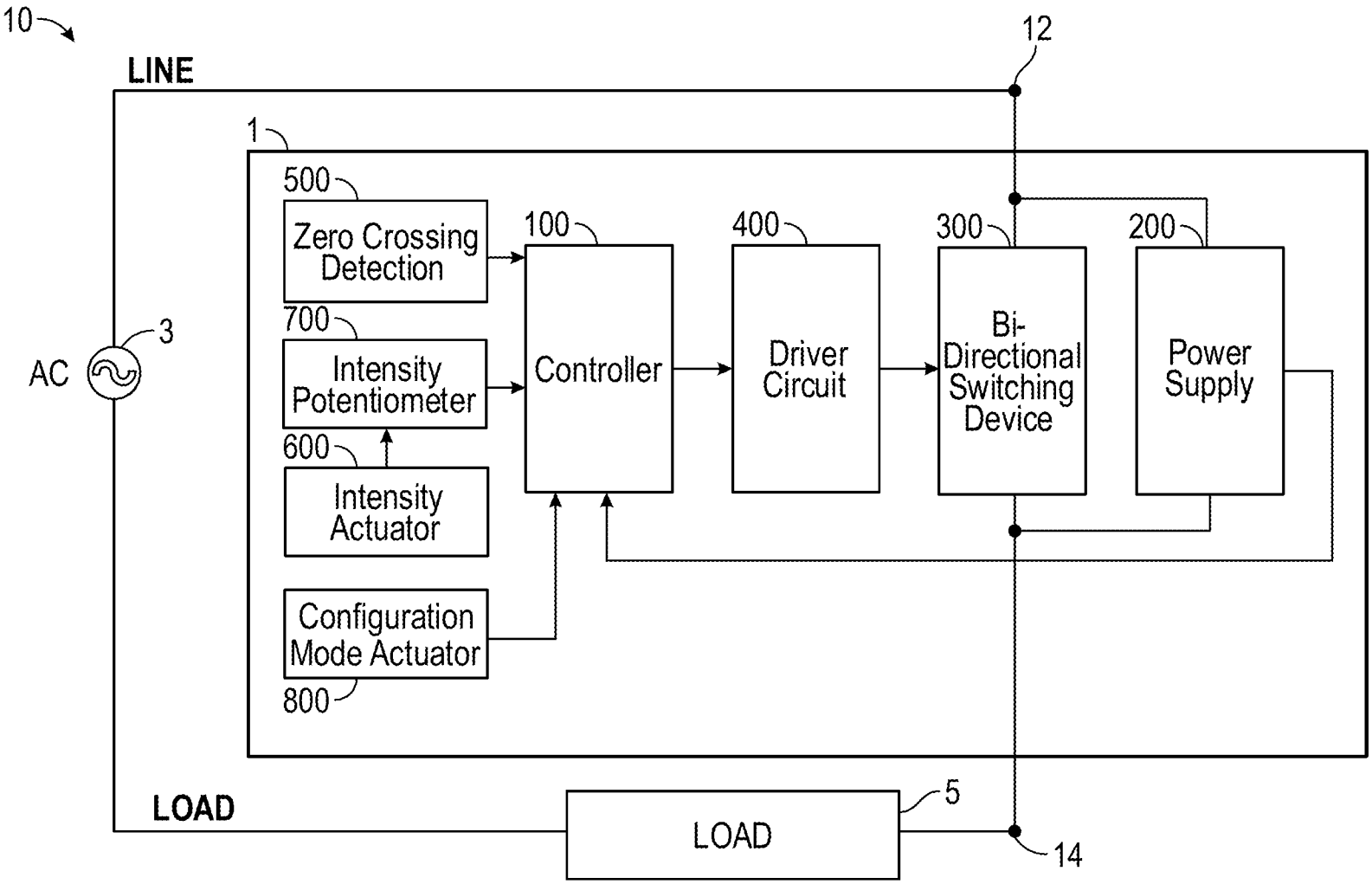
FIG. 1 is a schematic diagram of a dimmer system including a two-wire dimmer in accordance with an example embodiment of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the term "number" shall mean one or an integer greater than one (i.e., a plurality).

Conventional two-wire dimmers use a secondary potentiometer coupled to a secondary intensity actuator to achieve end-trimming functionality. The two-wire dimmers, however, do not have a capability for adjusting high-end trim level of the dimmers, thereby restricting the end trimming only to low-end trimming. Further, the two-wire dimmers use the primary actuator to control the amount of power delivery to the load and use the secondary actuator only for adjusting trimming end values. Additionally, controllers of the two-wire dimmers do not save the new low-end trim values selected by the user, and thus have to continuously monitor the voltage from the secondary actuator that is coupled to the secondary potentiometer which determines the minimum intensity, as well as the primary actuator input (main slider) that is connected to the primary potentiometer.

Example embodiments of the disclosed concept address these issues. The dimmers have distinct modes of operation: normal operation mode and configuration mode, and have capabilities to adjust both maximum intensity (high-end trim value) and minimum intensity (low-end trim value). The dimmers use a secondary actuator (e.g., push button(s), multi-position switch, or thumb wheel potentiometer) to switch between the normal operation mode and the configuration mode. In the configuration mode, the primary intensity actuator adjust a minimum level (low-end trim value) and/or maximum level (high-end trim value) intensity setting of the load control device (the dimmer). The addition of secondary actuator assists the controller to store one value of fine control input (end trimming input) in the memory, which will be continuously fetched until the next trim setting is done with help of the secondary actuator (e.g., push button) in the configuration mode. The embodiments also provide visual indication using illuminated actuator or LEDs connected to the dimmer in combination with the mode entered, e.g., configuration mode including increase or decrease trim levels. For example, a visual indication for entering and/or exiting the configuration mode may be made by ramping up and/or down the connected load's intensity. As such, the dimmers in accordance with the present disclosure provides an additional feature of high-end trimming (in addition to the low-end trimming), thereby giving the users more freedom in energy savings and dimming control possibly at no additional cost compared to the existing art with the secondary potentiometer for only the minimum intensity control. The dimmers also provide improved load compatibility and customer experience over a wide range of loads (e.g., lamps) with minimum accessory.

Figure 2A:
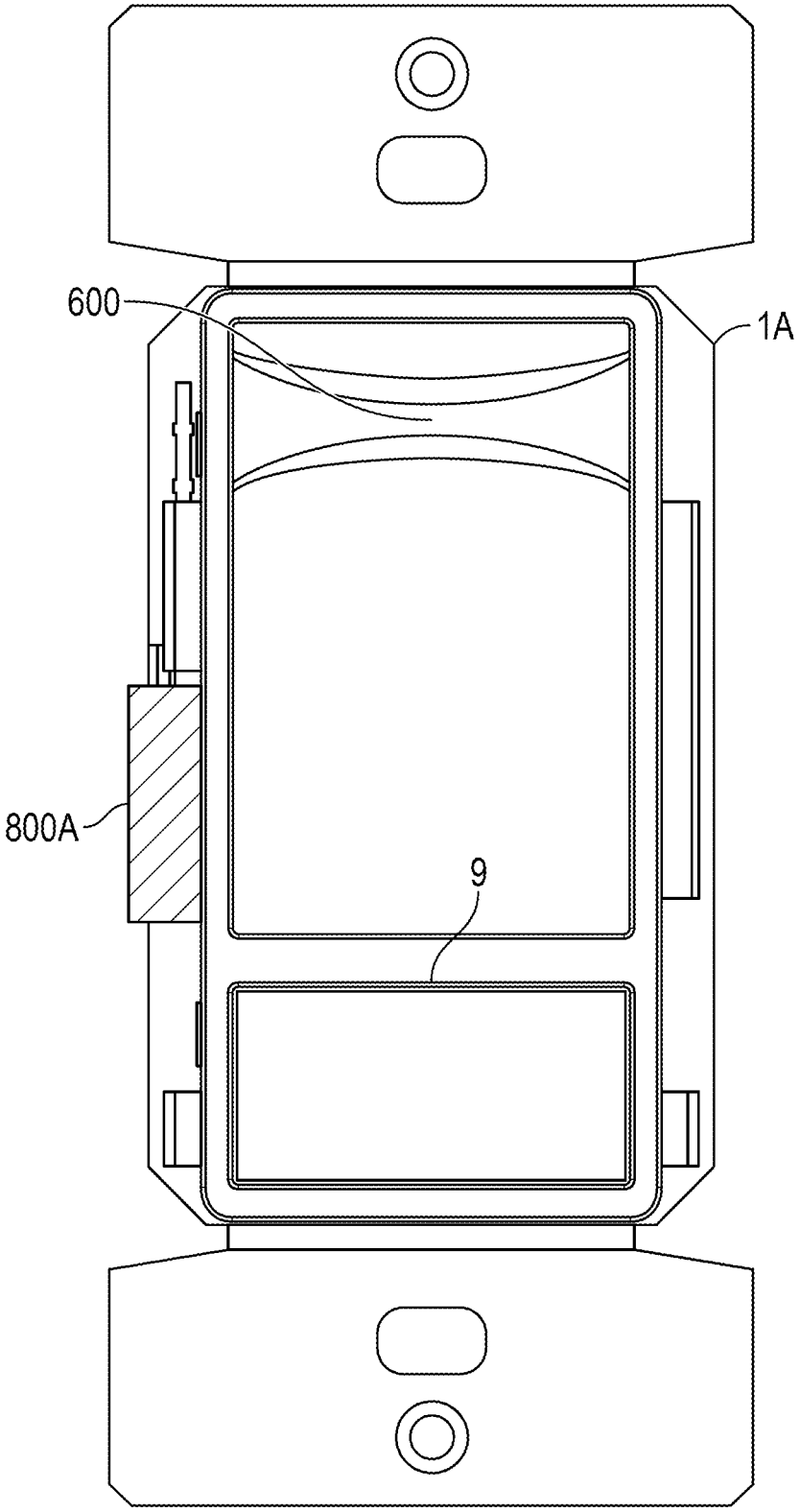
FIGS. 2A-G are diagrams of a dimmer in accordance with example embodiments of the disclosed concept.
Figure 2B:
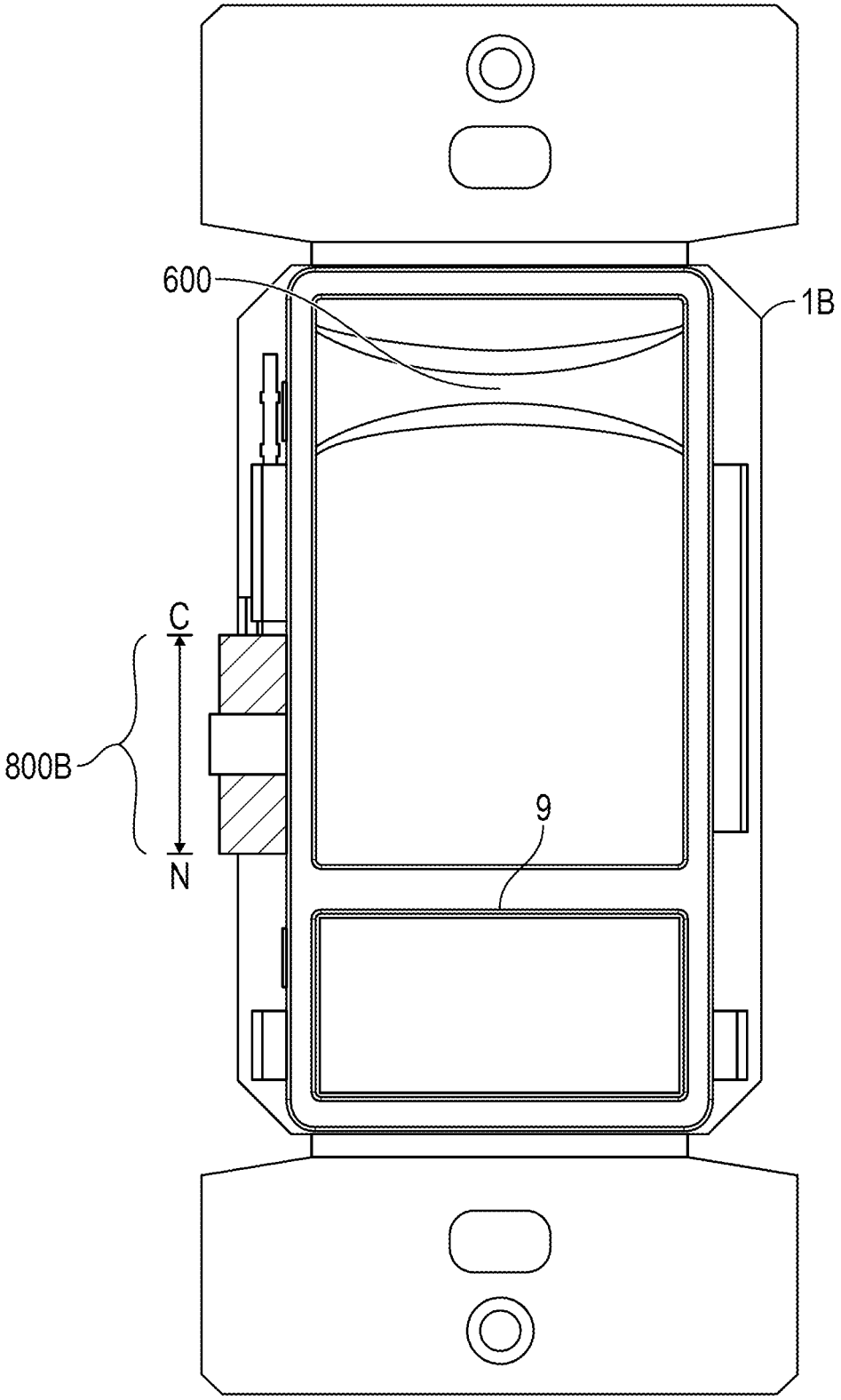
Figure 2C:
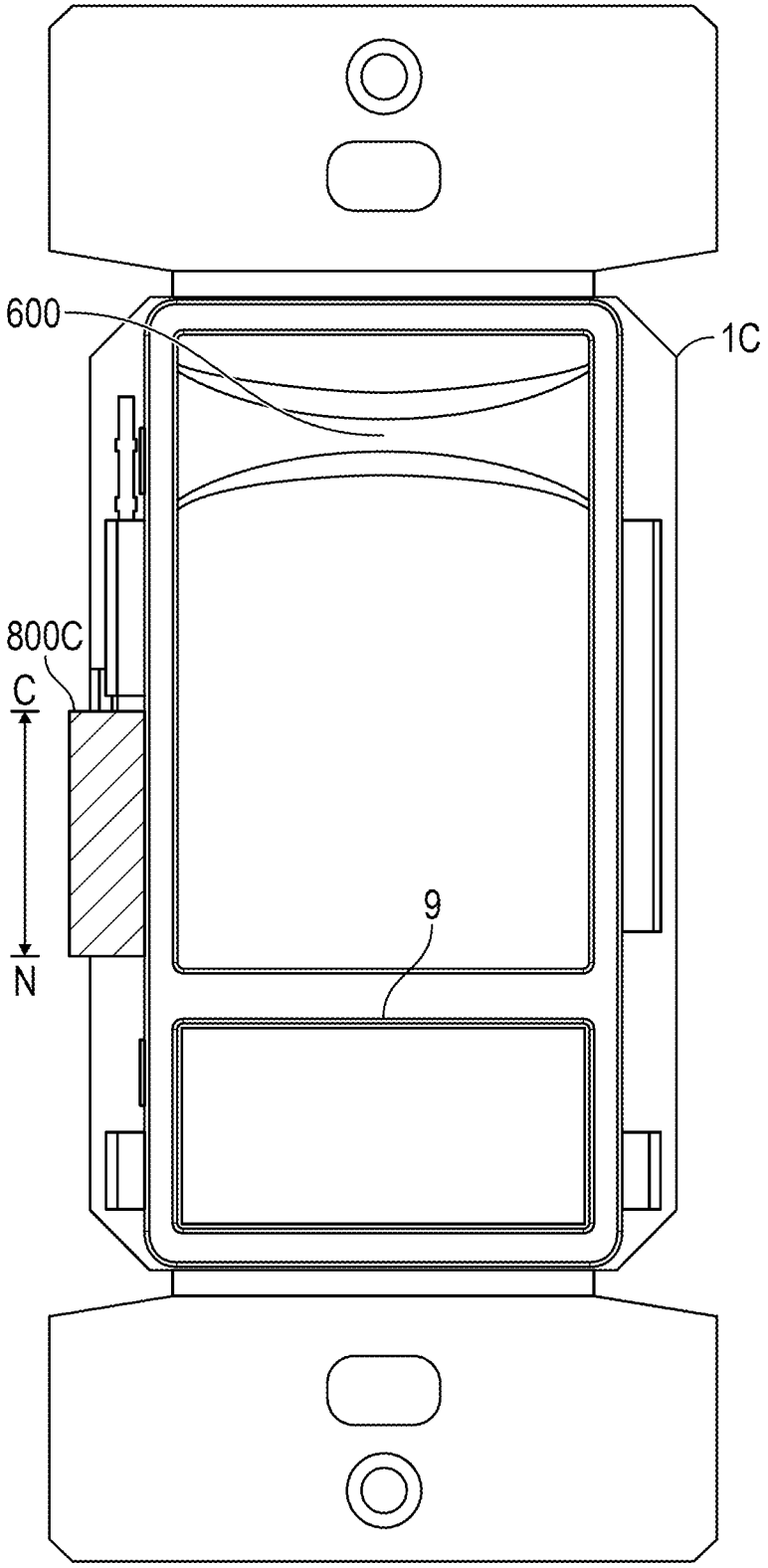
Figure 2D:
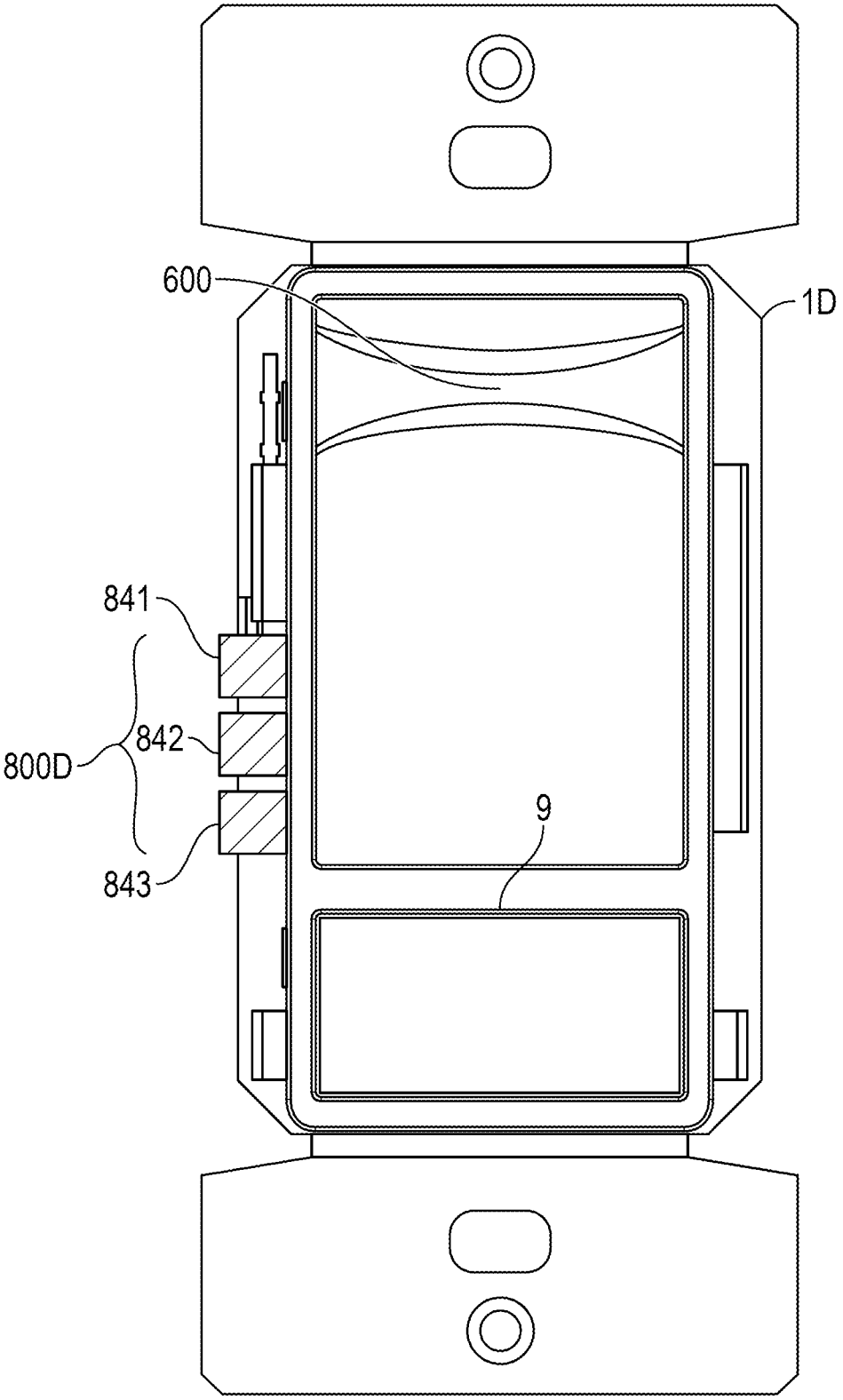
Figure 2E:
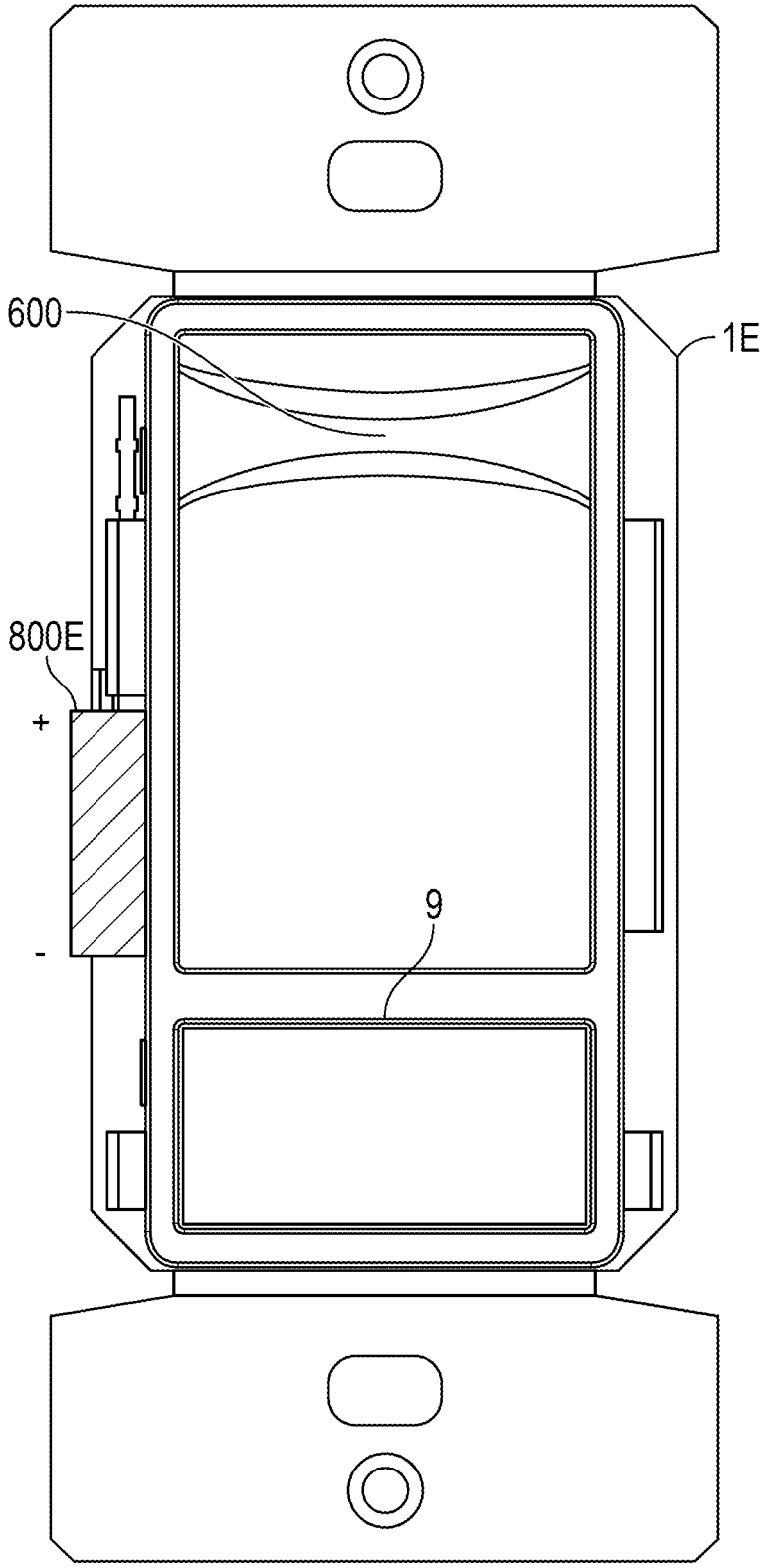
Figure 2F:
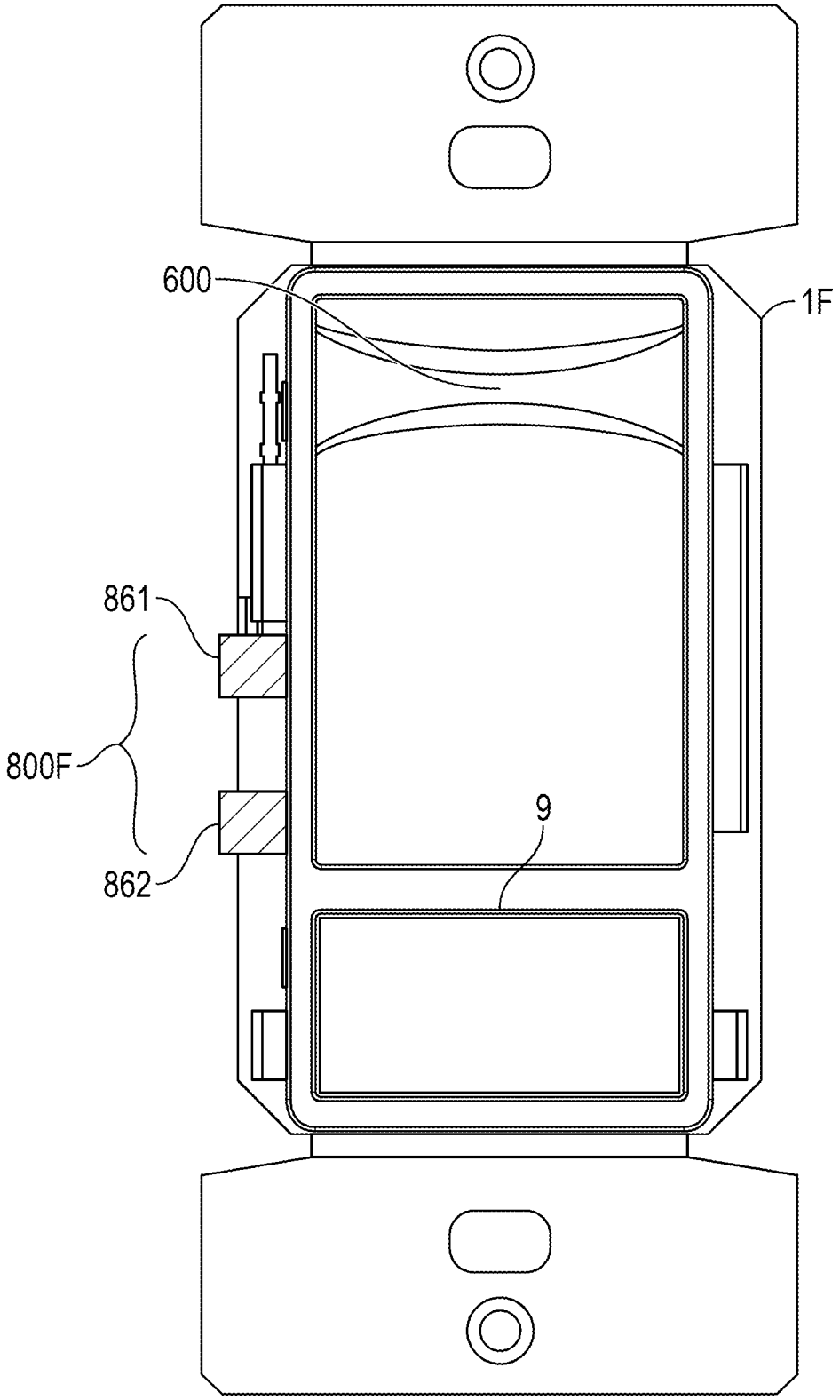

Thus, the embodiments in accordance with the present disclosure uses the secondary actuator(s) not to adjust, e.g., the minimum amount of power delivered to the electrical load (minimum light intensity), but to control the mode of operation (e.g., normal operation mode or configuration mode) of the dimmer. By using the secondary actuator(s) for the mode control, not only the minimum intensity but also maximum intensity can be adjusted. The secondary actuator may have multiple hardware options. For example, high-end and low-end trimming may be made with a thumb wheel potentiometer to control the mode of operation (e.g., the normal operation mode or the configuration mode) (as shown in FIG. 2C). In another example, high-end and low-end trimming may be made with different types of the secondary actuator to control the mode of operation. (e.g., push button, switch, etc. as shown in FIGS. 2A-B and G). In yet another example, high-end and low-end trimming may be made with multiple actuators to control the mode of operation. (e.g., push buttons, switches with multiple positions or options as shown in FIGS. 2D-F). As such, the user may choose actuator mechanism depending on the product types (e.g., lamps, LEDs, etc.).

FIG. 1 is a schematic diagram of a dimmer system 10 including a two-wire dimmer 1 in accordance with an example embodiment of the disclosed concept. The dimmer system 10 includes a LINE conductor 12 and a LOAD conductor 14. A two-wire dimmer 10 is coupled in series between an alternating-current (AC) power source 3 and the load 5. The AC power source 3 may be 120 Vac residential power or another suitable power source. The load 5 may be a lighting device (e.g., an incandescent lamp, a fluorescent light, LED, etc.). The two-wire dimmer 1 is structured to be mounted to a standard electrical wall-box and the LINE conductor 12 is coupled to the hot side of the AC power source 3 and a dimmed hot terminal 14 is coupled to the load 5. As such, the LINE conductor 12 may be also referred to as a HOT conductor, and the dimmed hot terminal 14 may be also referred to as a LOAD conductor. Two-wire dimmers do not require a connection to a NEUTRAL conductor. The dimmer 1 is structured to control dimming of the load 5 by controlling the nature of the power provided to the LOAD conductor 14. For example, in some example embodiments, the dimmer 1 is structured to cut off a part of the waveform provided to the LOAD conductor 14 each half-cycle. The power provided to the LOAD conductor 14 powers the load 5.

The dimmer 1 includes a controller 100, a power supply 200, a bidirectional switching device 300, a driver circuit 400, a zero crossing detector (ZCD) 500, a primary intensity actuator 600, a primary intensity potentiometer 700, and a configuration mode actuator 800. In some cases, the dimmer 1 may also include a configuration mode potentiometer coupled to a thumb wheel 800 (as shown in FIGS. 2C and G). The dimmer 1 may also include an external toggle button or rocker switch (a switch 9 as shown in FIGS. 2A-G) for turning the load 5 on or off by the user. The controller 100 is coupled to the primary intensity potentiometer 700, configuration mode actuator 800, and a driver circuit 400 coupled to a bidirectional switching device 300. The controller 100 is structured to control dimmer operation, including receiving a signal indicative of voltage ($V_{ADC}$) measured by the primary intensity potentiometer 700 for input to an analog to digital converter (ADC) pin of the controller 100, receiving a mode switching signal from the configuration actuator 800, and transmitting a dimming signal to the driver circuit 400 for driving the bidirectional switching device 300. The dimming signal based at least in part on the signal indicative of $V_{ADC}$. The controller 100 is further structured to store a new end trim value in a memory such that the controller 100 controls the dimmer operation without continuously monitoring an analog to digital converter pin for sensing the user input. The digital value corresponding to the new maximum or minimum intensity set during the configuration mode will be stored in the memory. The controller 100 may include look up table (LUT) or sequential logic for corresponding potentiometer values and firmware algorithm. The LUT or sequential logic takes care of setting trim value if the user wants to configure the maximum and/or minimum intensity or end trim level of the electrical load 5. Without the LUT or sequential logic, the dimmer 1 may require two primary intensity actuators: one for adjusting maximum intensity and another for adjusting minimum intensity. As such, including the LUT and sequential logic allows the dimmer 1 to have only one primary intensity actuator 600 to control maximum or minimum intensity, and thus, avoid adding extra hardware to the dimmer 1.

The controller 100 is also coupled to the power supply 200 for receiving DC power, the ZCD 500 for providing a signal indicating time when the bidirectional switching device 300 may be rendered conductive or nonconductive. The controller 100 is structured to control the operation of the dimmer 1. For example, the controller 100 may provide one or more control signals to control various functionalities (e.g., high-end and/or low-end trimming, entering configuration mode, exiting configuration mode, operating during normal mode, etc.) of the dimmer 1. The controller 100 may include a processor and a memory. The processor may be, for example and without limitation, a microprocessor, a microcontroller, or some other suitable processing device or circuitry, that interfaces with the memory. The memory can be any of one or more of a variety of types of internal and/or external storage media such as, without limitation, RAM, ROM, EPROM(s), EEPROM(s), FLASH, and the like that provide a storage register, i.e., a machine readable medium, for data storage such as in the fashion of an internal storage area of a computer, and can be volatile memory or nonvolatile memory.

The power supply 200 receives electrical energy from the AC power source 3 and supplies DC power to the controller 100 and other DC components within the dimmer 1. Upon powering on of the dimmer 1, the power supply 200 provides input voltage (e.g., 3.3V, 5V, etc.) to the controller 100, which in turn transmits a dimming signal to the driver circuit 400 based on the ADC input received from the primary intensity potentiometer 700. As such, upon power on, the power supply 200 receives AC voltage (e.g., 110V, 120V, 270V, etc.) from the AC power source 3, converts the AC voltage to DC voltage via a rectifier, performs voltage division so as to provide low voltage sufficient to power the control circuit 100 and other DC components within the dimmer 1.

The bidirectional switching device 300 may be a semiconductor switch, e.g., a thyristor (e.g., a triode for AC (TRIAC), two Field-Effect Transistors (FETs) in anti-series connection, etc.). The bidirectional switching device 300 is connected in series with the AC power source 3 and the load 5, and structured to control the amount of power delivered to the load 5 based at least in part on a signal received from a driver circuit 400, which is coupled to the bidirectional switching device 300 and structured to drive the bidirectional switching device 300. The bidirectional switching device 300 is structured to receive gate voltage signals from the driver circuit 400 for becoming conductive or non-conductive. The bidirectional switching device 300 is structured to control the amount of power delivered to the load 5, by becoming conductive or non-conductive for parts of a half-cycle of the AC power source 3 based on the signal received from the driver circuit 400. The bidirectional switching device 300 may use a forward phase-control or reverse phase-control in order to control when the bidirectional switching device 300 controls the power delivered to the lighting load 5.

The driver circuit 400 is coupled to the controller 100 and the bidirectional switching device 300. The driver circuit 400 drives the bidirectional switching device 300 by providing a signal (e.g., a gate drive signal) to the gate of the bidirectional switching device 300. The driver circuit 400 may be a TRIAC control circuit and is structured to receive waveforms, e.g., dimming signals, from the controller 100, and control the operation of the TRIAC and any other components of the driver circuit 400. A dimming signal may include a ZCD signal which indicates timing of when the AC is crossing zero. The driver circuit 400 may render the bidirectional switching device 300 conductive or non-conductive based at least in part on the ZCD signal. The driver circuit 400 may provide a constant gate voltage signal to the bidirectional switching device 300 so that the bidirectional switching device 300 is constantly supplied with power.

Zero crossing detector (ZCD) 500 is structured to detect current crossing at near zero as the sine signal repeatedly goes up to its peak current and down to zero current. Upon detecting such crossing, the ZCD 500 transmits a signal to the controller 100, which in turn activates the driver circuit 400 and transmit the ZCD signal to the driver circuit 400 for controlling the bidirectional switching device 300. ZCD 500 may be used for protecting electronic devices from a power surge upon switching on of the devices. For example, when an electronic device is switched on, the device may be subjected to a sudden entry of the AC and if this entry point occurs at the peak of the AC sinusoidal signal, the device may experience maximum current supplied at the switching on, thereby damaging the electronic device. As such, ZCD ensures that during power on of the devices, the AC mains would be entering its first zero crossing point, thereby protecting the electronic devices such as the load 5 from a power surge at power on and preventing damage to the load 5 due to the power surge. Further, the driver circuit 400 controls the bidirectional switching device 300 based at least in part of the ZCD signal as to determining when the bidirectional switching device 300 should be conductive or non-conductive.

Primary intensity actuator 600 is operable by the user and coupled to the DC power supply 200 and the primary intensity potentiometer 700 and structured to control the amount of power delivered to the load 5 between the minimum amount of power and the maximum amount of power in normal operation mode. The primary intensity actuator 600 and the primary intensity potentiometer 700 are mechanically coupled to each other, and thus, when the user actuates the primary intensity actuator 600 (e.g., by moving, sliding, pressing, pushing, etc.), both the primary intensity actuator 600 and the primary intensity potentiometer 700 move in unison. The primary intensity actuator 600 (e.g., a slider) coupled to the potentiometer 700 is used for the dimmer 1 to operate in both the configuration mode and normal operation mode. In configuration mode, the primary intensity actuator 600 coupled to the potentiometer 700 is used to adjust maximum intensity and/or minimum intensity of the load 5. In normal operation mode, the primary intensity actuator 600 is structured to dim the light between the maximum intensity and minimum intensity set during configuration mode. Upon exiting the configuration mode, the controller 100 stores the value of new end trim value.

The primary intensity actuator 600 may perform high-end trimming and/or low-end trimming upon the dimmer 1 entering the configuration mode. High-end or low-end trimming refers to the adjustment of maximum or minimum intensity of the light load 5, which is controlled by the maximum or minimum amount of power delivered by the dimmer 1 connected to the light load 5. For high-end trimming, the user actuates the primary intensity actuator 600 to maximum intensity or above a high threshold (e.g., 60% intensity) before entering the configuration mode (e.g., before or after turning on the dimmer 1 or during the normal operation of the dimmer 1). Next, the dimmer 1 enters the configuration mode by the user actuating the configuration actuator 800. The user then actuates the primary intensity actuator 600 to a new high-end trim value as desired. The controller 100 in turn stores the new high-end value in memory. Upon lapsing of a predetermined period (e.g., five seconds), the dimmer 1 exits the configuration mode and operates in the normal operation mode based at least in part on the new high-end value. For low-end trimming, the user actuates the primary intensity actuator 600 to minimum intensity or below low threshold (e.g., 40% intensity) before entering the configuration mode. The dimmer 1 then enters the configuration mode by the user actuating the configuration actuator 800. Next, the user actuates the primary intensity actuator 600 to a new low-end trim value as desired. The controller 100 then stores the new low-end trim value in memory. Upon lapsing of a predetermined period (e.g., without limitation, five seconds), the dimmer 1 exits the configuration mode and operates in the normal operation mode based at least in part on the new low-end trim value. In the normal operation mode, the primary intensity actuator 600 is used to adjust the load intensity based at least in part on the new low-end trim value.

Primary intensity potentiometer 700 is mechanically coupled to the controller 100 and the primary intensity actuator 600 and includes a variable resistor. The primary intensity potentiometer 700 is structured to measure voltage based on variable resistance. The variable resistor is connected in series with a regular resistor and is coupled to a wiper (e.g., a sliding contact), which is in turn mechanically coupled to the primary intensity actuator 600. The variable resistance changes in accordance with the position of the primary intensity actuator 600 and the primary intensity potentiometer 700. As the user actuates the primary intensity actuator 600, the primary intensity potentiometer 700 coupled to the primary intensity actuator 600 is actuated in unison with the primary intensity actuator 600. The primary intensity potentiometer 700 acts as a voltage divider and measures the voltage at a junction between the variable resistor and the regular resistor. This voltage may be referred to as $V_{ADC}$ since it is input to the controller 100 via the controller's analog to digital converter (ADC) pin. As such, the primary intensity potentiometer 700 measures $V_{ADC}$ indicative of the voltage change based on the variable resistance in accordance with the position of the primary intensity actuator 600, and transmits a $V_{ADC}$ signal to the controller 100, which in turn sends a dimming signal to the driver circuit 400 based at least in part on $V_{ADC}$.

The configuration actuator 800 is coupled to controller 100 and is structured to be used by the user for switching mode of operation. The dimmer 1 has two modes: normal operation mode and configuration mode. When the user desires to change the end-trim values (from, e.g., without limitation, factory setting, or previously set end-trim values), the user actuates the configuration actuator 800 in order to switch to configuration mode. Upon switching to the configuration mode, the user actuates the primary intensity actuator 600 to adjust the end-trim values (maximum or minimum intensity).

Figure 2G:
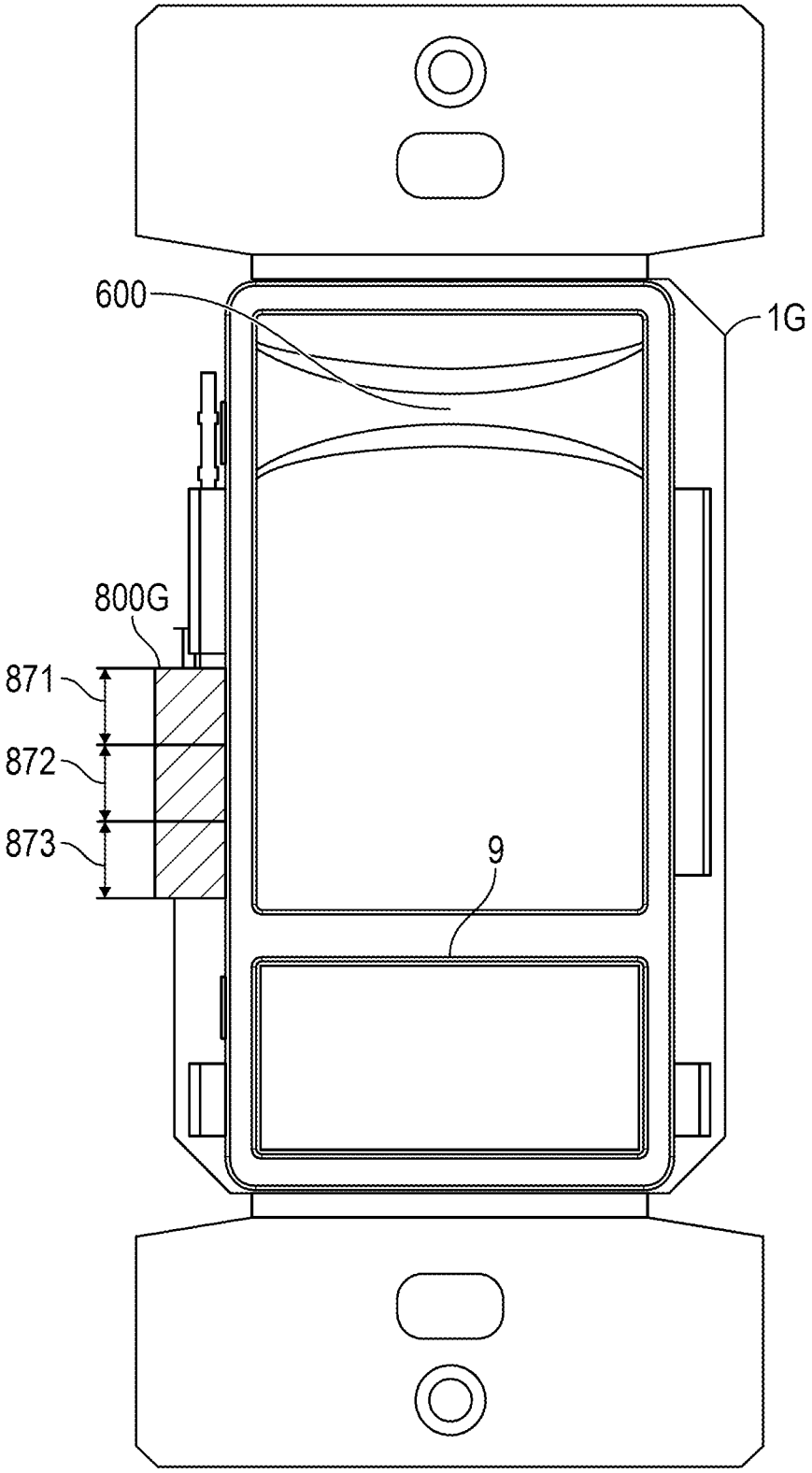

The configuration actuator 800 may be, e.g., push button(s), multi-position switch, or thumbwheel coupled to a secondary potentiometer. For example, the configuration actuator 800 may be a single push button (as shown in FIG. 2A) for switching to the configuration mode; a two position switch (as shown in FIG. 2B) for switching to the configuration mode by actuating the switch to one position and to the normal operation mode by actuating the switch to the other position; a thumbwheel (as shown in FIG. 2C) for switching to the configuration mode by actuating the thumbwheel to one direction and to the normal operation mode by actuating the thumbwheel to the other direction; three push buttons (as shown in FIG. 2D) for switching to the configuration mode by pushing a configuration mode button, for increasing an end trim value by an increase ('+') button, and for decreasing an end trim value by a decrease ('−') button; a dual push button (as shown in FIG. 2E) for increasing an end trim value via an increase ('+') end) and for decreasing an end trim value by a decrease ('−') end); two push buttons (as shown in FIG. 2F) for entering into the configuration mode by pressing a configuration mode button and for resetting the dimmer 1 to factory setting by pressing a reset button; and a three position slide switch or thumbwheel (as shown in FIG. 2G) for operating in a normal operation mode when actuated to a normal position, for adjusting high-end trim value when actuated to a high end position, and for adjusting low-end trim value when actuated to a low end position.

The addition of the configuration actuator 800 may help the controller 100 to store one value of fine control input (i.e., low-end and/or high/end trim values) in memory, which may be continuously fetched for the operation of the dimmer 1. Optionally, there may be a visual indication for switching of the mode, using illuminated actuator or LEDs connected to the dimmer 1 in combination with the mode entered (e.g., the configuration mode for increasing or decreasing end-trim values). For example, when entering the configuration mode for low-end trimming, the dimmer 1 may ramp down the load intensity to minimum, then up to maximum and then back down to minimum. When exiting the configuration mode for low-end trimming, the dimmer 1 may ramp the load intensity down to minimum, then up to maximum, then back down to minimum, and then to the new low-end trim level. When entering the configuration mode for high-end trimming, the dimmer 1 may ramp down the load intensity to minimum, then up to maximum. When exiting the configuration mode for high-end trimming, the dimmer 1 may ramp the load intensity up to maximum, then down to minimum, then back up to maximum, and to the new high-end trim level.

Thus, the embodiments in accordance with the present disclosure uses the configuration actuator 800 not to adjust the minimum amount of power delivered to the electrical load (minimum light intensity), but to control the mode of operation (e.g., normal operation mode or configuration mode) of the dimmer. By using the configuration actuator 800 for the mode control, not only the minimum intensity but also maximum intensity can be adjusted. Further, the configuration actuator 800 may have multiple hardware options, thereby allowing the user to choose actuator mechanism depending on the product types of the load 5. For example, high-end and low-end trimming (maximum and minimum intensity adjustment) may be made with a thumbwheel potentiometer to control the mode of operation (e.g., the normal operation mode or the configuration mode) (as shown in FIG. 2C). In another example, high-end and low-end trimming may be made with different types of the secondary actuator to control the mode of operation. (e.g., a push button, a switch, etc. as shown in FIGS. 2A-B). In yet another example, high-end and low-end trimming may be made with multiple actuators to control the mode of operation. (e.g., push buttons, switches with multiple positions or options as shown in FIGS. 2D and F). Further, the multiple hardware options for the configuration actuator 800 provides improved load compatibility and customer experience over a wide range of loads with a minimum accessory.

FIGS. 2A-G are diagrams of a dimmer 1A-G in accordance with example embodiments of the disclosed concept. FIG. 2A shows a dimmer 1A, including a primary intensity actuator 600, a configuration actuator 800A, and a toggle button or rocker switch 9 for turning on and off the dimmer 1. The configuration actuator 800A may be a single push button. In general, when the single push button 800A is pressed in, it may send respective signal to the controller 100. Upon entering the configuration mode, if the primary intensity actuator (e.g., a main slider) 600 is at minimum or maximum intensity position, the dimmer 1A enables the user to set a new low or high-end trimming value, respectively. The user may move the main slider 600 to set a new low or high-end trimming value, and the voltage corresponding to the latest primary intensity actuator position (e.g., the main slider position) may be stored as the new low or high-end trimming value in the memory (which may be included in the controller 100 or a separate component within or external to the dimmer 1A). Once the dimmer 1A enters the configuration mode, it stores the new end-trim value before exiting out of the configuration mode after a predetermined period (e.g., five seconds) and operates in the normal operation mode. In this way, single actuator/potentiometer (primary) 600/700 is used for both end trimming and normal dimming operation, and the configuration actuator 800A is used for switching the mode of operation only.

For low-end trimming, the user may actuate the primary intensity actuator (e.g., a main slider) 600 to the minimum intensity position or below a low threshold (e.g., 40% intensity) before entering the configuration mode. Next, the user actuates (e.g., press, push, etc.) the single push button 800A to enter the configuration mode. Upon actuating the single push button 800A, a signal to switch the mode of the dimmer 1A to the configuration mode is transmitted from the single push button 800A to the controller 100. Optionally, there may be a visual indication for the dimmer 1A entering the configuration mode. In the configuration mode, the user may adjust the low-end trim value (e.g., factory set or previously set by the user) by sliding the primary intensity actuator 600 to a position indicative of a new low-end trim value as desired. The controller 100 stores the new low-end trim value to the memory. Then, upon a lapse of a predetermined period (e.g., five seconds), the controller 100 stores the new low-end trim value to the memory. Optionally, there may be a visual indication for exiting the configuration mode, e.g., by ramping the load intensity down to minimum, then up to maximum, then back to minimum, and then to the new low-end trim level. During the visual indications (for entering and exiting the configuration mode), the user may not actuate the primary intensity actuator 600. Upon exiting the configuration mode, the dimmer 1 operates in the normal operation mode based at least in part on the new low-end value.

For high-end trimming, the user may actuate the primary intensity actuator (e.g., a main slider) 600 to the maximum intensity position or above high threshold (e.g., 60% intensity) before entering the configuration mode (e.g., before or after turning on the dimmer 1, during the normal operation of the dimmer 1, etc.). Next, the user actuates (e.g., press, push, etc.) the single push button 800A to enter the configuration mode. Upon actuating the single push button 800A, a signal to switch the mode of the dimmer 1A to the configuration mode is transmitted from the single push button 800A to the controller 100. Optionally, there may be a visual indication for the dimmer 1A entering the configuration mode, e.g., by ramping the load intensity to maximum, then to minimum, then back to maximum. In the configuration mode, the user may adjust the high-end trim value (e.g., factory set or previously set by the user) by sliding the primary intensity actuator 600 to a position indicative of a new high-end trim value as desired. Then, upon a lapse of a predefined period (e.g., five seconds), the controller 100 stores the new high-end trim value to the memory. Upon a lapse of the predetermined period (e.g., five seconds), the dimmer 1A exits the configuration mode. Optionally, there may be a visual indication for exiting the configuration mode, e.g., by ramping the load intensity up to maximum, down to the minimum, back to the maximum intensity and finally to the new high-end trim level. Upon exiting the configuration mode, the dimmer 1 operates in the normal operation mode based at least in part on the new low-end value.

FIG. 2B shows a dimmer 1B including a primary intensity actuator 600, a rocker switch 9, and a configuration actuator 800B. The configuration actuator 800B may include a two position switch control including a configuration mode position C and a normal operation mode position N. The user may move the primary intensity actuator 600 (e.g., a main slide) to maximum intensity (or above high threshold) or minimum intensity (or below low threshold) for high-end trimming or low-end trimming, respectively. The user may then push the configuration actuator 800B to the configuration mode position for maximum or minimum trimming. The two position switch in the configuration or normal operation mode sends respective signal to the controller 100. In the configuration mode, depending on the primary intensity actuator position (e.g., minimum (or below low threshold) or maximum (or above high threshold) intensity position), the two position switch 800B may enable user to set low-end or high-end trim value respectively. The latest primary intensity actuator position may be stored as a new low-end or high-end intensity or trim value in the controller memory before a lapse of a predetermined period (e.g., five seconds). Every time when the two position switch 800B is set to the configuration mode, the controller 100 replaces the old end trim value stored with new end trim value in the memory. If the two position switch 800B is not set back to the normal operation mode within the predetermined period, the dimmer 1B may exit the configuration mode and enters the normal operation mode. Next time when the user desires to switch to the configuration mode, the dimer 1B may be required to get back to the normal operation mode and then switch again to the configuration mode.

FIG. 2C shows a dimmer 1C including a primary intensity actuator 600, a rocker switch 9, and a configuration actuator 800C. The configuration actuator 800C may include a thumb wheel coupled to a secondary potentiometer as a two position switch. For end trimming, the user first actuates the primary intensity actuator 600 to a maximum (or above the high threshold) for high-end trimming or minimum (or below the low threshold) for low-end trimming before entering the configuration mode. Then, the user may push or slide the thumb wheel 800C to configuration mode position C for maximum (high-end) trimming if the user has placed the primary intensity actuator 600 to the maximum intensity position or minimum (low-end) trimming if the user has placed the primary intensity actuator 600 to the minimum intensity position before entering the configuration mode. In this option, a thumb wheel 800C is used as a switch changing between two positions: configuration mode position and normal mode position. A band of voltage is specified in such a way that when the thumb wheel 800C is in an extremely low end or the thumb wheel ADC voltage is below a first predetermined voltage (e.g., 2.5 v), the dimmer 1C is to operate in the normal operation mode. Alternatively, when thumb wheel 800C is in an extremely high end or thumb wheel ADC voltage is above the predetermined voltage, the dimmer 1C is to enter the configuration mode. And based on the position of the primary intensity actuator/potentiometer before entering the configuration mode, the dimmer 1C enters the configuration mode for low-end trimming (e.g., if the primary intensity actuator 600 is at minimum) or high-end trimming (e.g., if the primary intensity actuator 600 is at maximum). The latest primary intensity actuator position is stored as a new low-end or high-end intensity or trim value in the controller memory before a predetermined period (e.g., 5 seconds) lapses. Every time when the configuration mode is set, the controller 100 replaces the old end trim value stored with new end trim value in the memory.

FIG. 2D shows a dimmer 1D including a primary intensity actuator 600, a rocker switch 9, and a configuration actuator 800D. The configuration actuator 800D may include a three push button control: an increase ('+') button 841, a decrease ('−') button 843, and a configuration mode button 842. The three separate push buttons are used to enter the configuration mode and then to increase or decrease the end trim value. The increase button 841 increases the intensity in a fixed step size as defined in firmware e.g. 5% or 10%, and similarly, the decrease button 843 reduces the intensity in a fixed step size. Before entering the configuration mode, the user actuates the primary intensity actuator 600 to select the type of end trimming desired. The user actuates the primary intensity actuator 600 to maximum intensity (or above a high threshold) for high-end trimming, or to minimum intensity (or below a low threshold) for low-end trimming. In the configuration mode, depending on the primary intensity actuator position set before entering the configuration mode, the dimmer 1D enables the user to set low-end or high-end trim value. The last value of respective button press will store the count in the controller memory, and this value is used as a new low-end or high-end trim value until the configuration button 842 is pressed next. If no button is pressed within a predetermined period (e.g., five seconds), the dimmer 1D may operate in the normal operation mode. The use of the increase or decrease button 841, 843 is illustrated in FIGS. 19 and 20.

FIG. 2E shows a dimmer 1E including a primary intensity actuator 600, a rocker switch 9, and a configuration actuator 800E. The configuration actuator 800E may be a dual or two push button control including an increase ('+') end and a decrease ('−') end. For end trimming, the user first moves the primary intensity actuator 600 to maximum intensity (or above a high threshold) for high-end trimming or minimum intensity (or below a low threshold) for low-end trimming before entering the configuration mode. The user sees the intensity change as the dimmer light changes, and stops pressing the button's end when s/he sees the intensity level s/he likes. The configuration actuator 800E does not have a separate configuration button to indicate to the controller 100 that the dimmer 1E is in the trim setting. But each time the increase ('+') or decrease ('−') end is pressed along with the primary intensity actuator's low-end or high-end trim level for a predetermined period (e.g., five seconds), the configuration actuator 800E enables the user to set a new low-end or high-end trim value in a fixed step size. The latest primary intensity actuator position is stored as a new low-end or high-end intensity or trim value in the controller memory before the predetermined time lapses. If no increase ('+') or decrease ('−') switch is pressed within the predetermined period, the controller 100 brings back the dimmer 1E in the normal operation mode.

FIG. 2F shows a dimmer IF including a primary intensity actuator 600, a rocker switch 9, and a configuration actuator 800F. The configuration actuator 800E includes a two push button control and uses two push buttons to enter the configuration mode and to reset (e.g., setting the dimmer 1E back to the factory default maximum (100%) or minimum (0%) intensity). Before entering the configuration mode, the user selects the type of end trimming to be performed. For high-end trimming, the user actuates the primary intensity actuator 600 to maximum intensity or above a high threshold. For low-end trimming, the user actuates the primary intensity actuator 600 to minimum intensity or below a low threshold. When the user presses the configuration push button 861 with respect to the primary intensity actuator's low or high level, the user is enabled to set low or high intensity or trim value. When the 'reset' button 862 is pressed, the dimmer 1E sets the low-end and high-end trim values to default settings. If no button is pressed in the configuration mode within a predetermined period (e.g., 5-10 sec), the controller 100 brings back the dimmer 1E to the normal operation mode.

FIG. 2G shows a dimmer 1G including a primary intensity actuator 600, a rocker switch 9, and a configuration actuator 800G. The configuration actuator 800G may be one thumb wheel (coupled to a secondary potentiometer) or three position slide switch, including a high position 871, a low position 873, and a normal operation mode position 872. Before entering the configuration mode, the user selects the type of end trimming to be performed. For high-end trimming, the user actuates the primary intensity actuator 600 to maximum intensity or above a high threshold. For low-end trimming, the user actuates the primary intensity actuator 600 to minimum intensity or below a low threshold. Then, the user pushes or slides the thumb wheel 800G for maximum (high-end) or minimum (low-end) trimming. The dimmer 1G allows low-end and high-end trimming control with single thumb wheel potentiometer or three position switch 800G. When the configuration actuator 800G is at the high position (e.g., voltage band 1) 871, the user input via the primary intensity actuator 600 is considered as input for high end trimming. With the configuration actuator 800E in the low position 873 (e.g., voltage band 2), the user input via the primary intensity actuator 600 is considered as a low end trimming input. When the configuration actuator 800G is at the normal position N (e.g., voltage band 3), the user input via the primary intensity actuator 600 is considered as a normal operation mode dimming control input. If the configuration actuator (e.g., a switch/potentiometer) 800G is not pressed or not brought back to the normal operation mode, the dimmer 1G returns to the normal operation mode after a predetermined period (e.g., 5 seconds) lapses. If the user desires to switch to the configuration mode, the dimmer 1G is required to return to the normal operation mode and switch again to the configuration mode.

In all embodiments illustrated in FIGS. 2A-G, in order to indicate that the dimmer 1A-G enters and/or exits from the configuration mode, the load 5 may be ramped up or down to the factory maximum or minimum intensity, then ramp up or down to the new high-end or low-end intensity. During this time, the user may not control the intensity by moving the primary intensity actuator 600. For entering low-end trimming configuration, the load 5 may be ramped down to minimum, to maximum, then back to minimum intensity, for exiting the low-end trimming configuration, the load 5 may be ramped down to minimum, to maximum, back to minimum and then to the new low-end trim value. For entering high-end trimming configuration, the load 5 may be ramped down to minimum and up to maximum intensity. For exiting high-end trimming configuration, the load 5 may be ramped up to maximum, to minimum, back up to maximum and then to the new high-end trim value.

Figure 3:
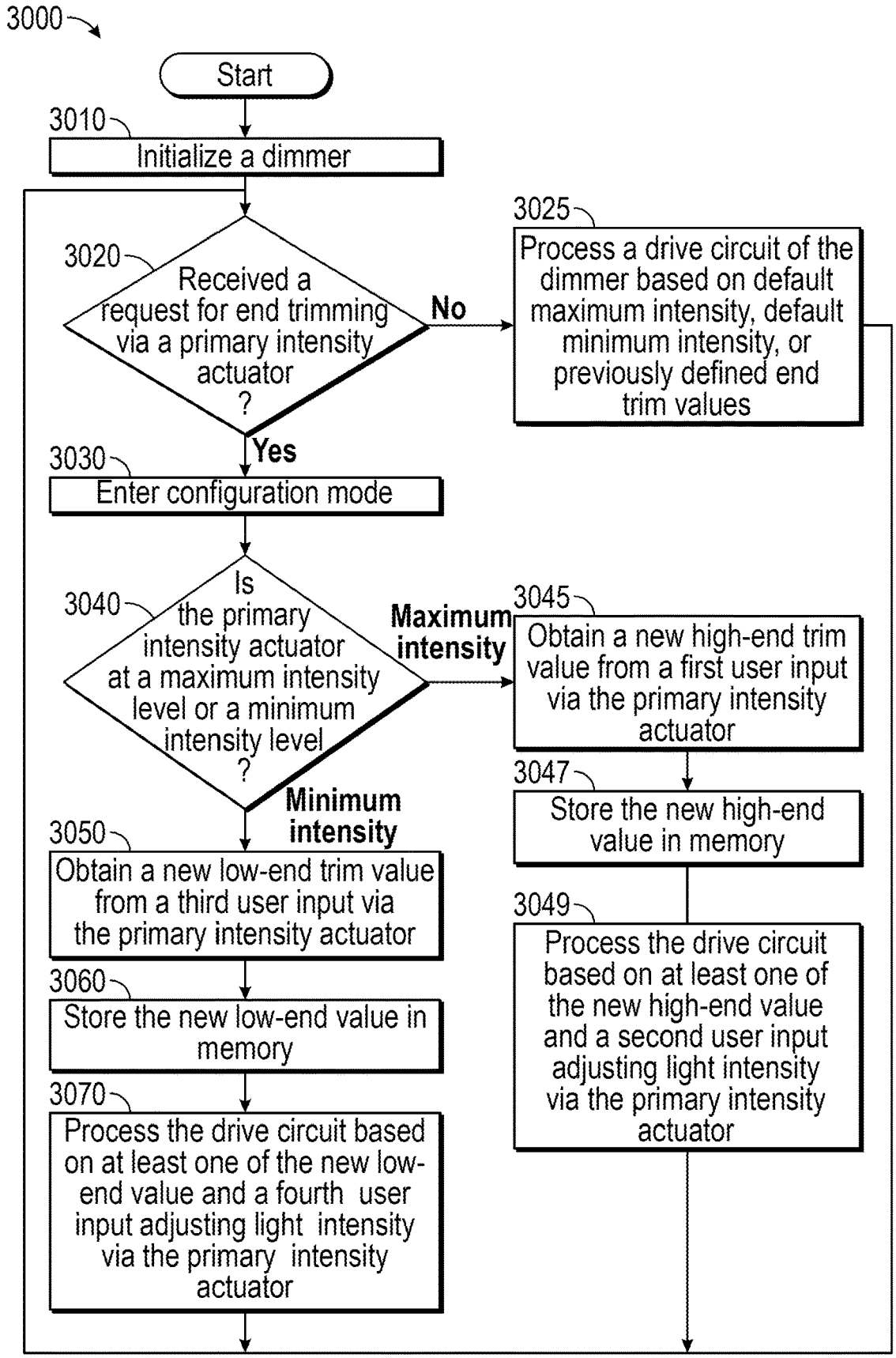
FIG. 3 is a flow chart for a method of adjusting an end trim value in accordance with an example embodiment of the disclosed concept.

FIG. 3 is a flow chart for a method 300 of adjusting an end trim value in accordance with an example embodiment of the disclosed concept. The method 3000 may be performed by a user, the dimmer 1 or any components therein as described with reference to FIG. 1. The method 3000 is applicable to the embodiments described with reference to FIGS. 2A-C and E-G.

At 3010, the dimmer initializes.

At 3020, the controller determines whether a request for end trimming has been received via a primary intensity actuator. If no, at 3025 the controller processes a drive circuit of the dimmer based on default maximum intensity, default minimum intensity, or previously defined end trim values, and the method 3000 returns to 3020. If yes, the method 3000 proceeds to 3030.

At 3030, the dimmer enters configuration mode.

At 3040, the controller determines whether the primary intensity actuator has been actuated to a maximum intensity level (or above a high threshold) or a minimum intensity level (or below a low threshold) before entering the configuration mode (e.g., before or after turning on the dimmer, during the normal operation of the dimmer, etc.). If the primary intensity actuator is at the maximum intensity (or above the high threshold), at 3045 the controller obtains a new high-end trim value from a first user input via the primary intensity actuator. The new high-end trim value is obtained from the user input actuating the primary intensity actuator to a position indicative of the new high-end value selected by the user. At 3047, the controller stores the new high-end value in the memory. At 3049, the controller processes the drive circuit based on at least one of the new high-end value and a second user input adjusting light intensity via the primary intensity actuator, and then the method 3000 returns to 3020. If, at 3040, the primary intensity actuator is at minimum intensity (or below the low threshold), the method 3000 proceeds to 3050.

At 3050, the controller obtains a new low-end trim value from a third user input via the primary intensity actuator. The third user input is made by the user by actuating the primary intensity actuator to a position indicative of a new low-end trim value selected by the user.

At 3060, the controller stores the new low-end value in memory.

At 3070, the controller processes the drive circuit based on at least one of the new low-end value and a fourth user input adjusting light intensity via the primary intensity actuator and the method 3000 returns to 3020.

Figure 4:
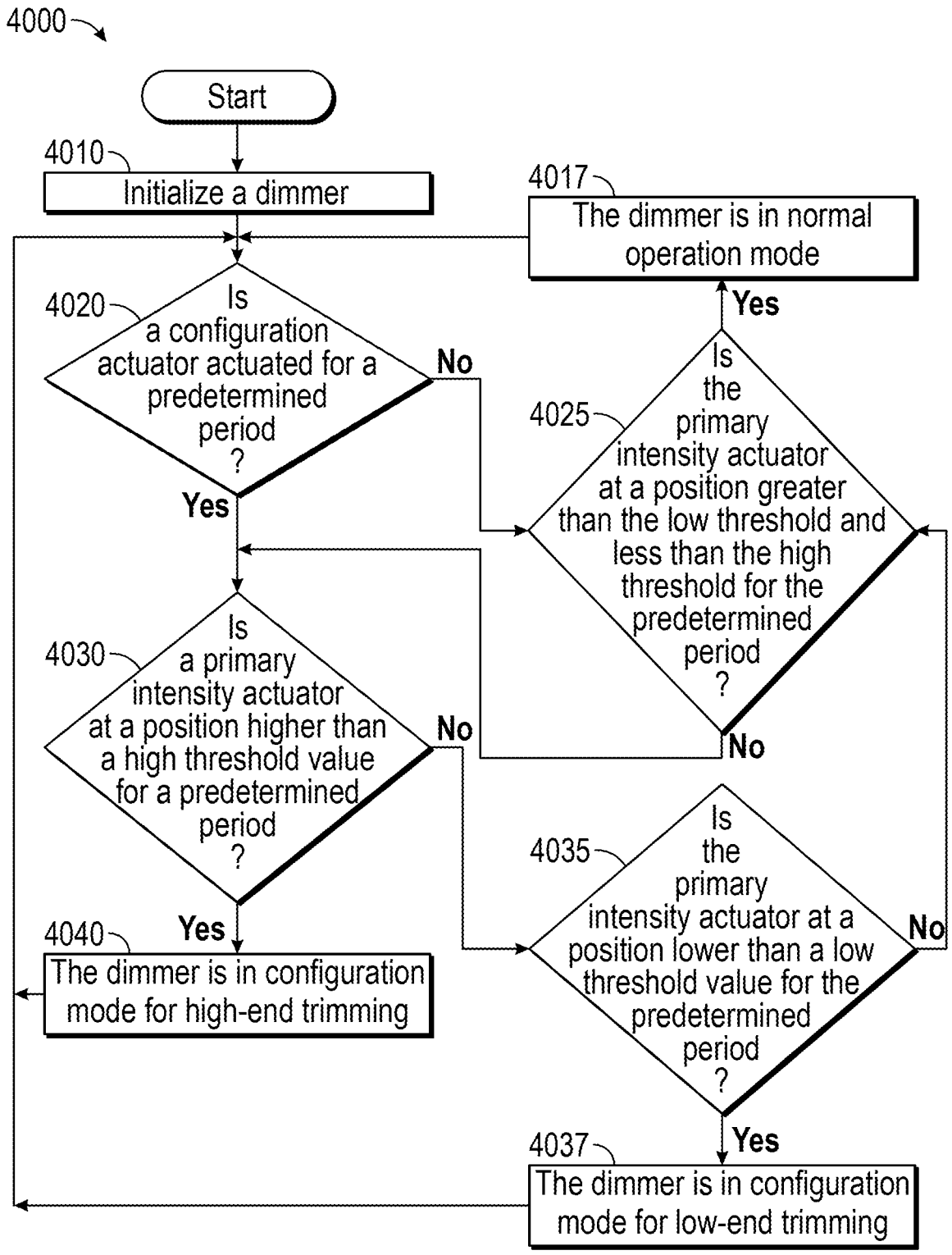
FIG. 4 is a flow chart for a method of obtaining dimmer mode in accordance with an example embodiment of the disclosed concept.

FIG. 4 is a flow chart for a method 4000 of obtaining dimmer mode in accordance with an example embodiment of the disclosed concept. The method 4000 may be performed by a user, the dimmer 1 or any components therein as described with reference to FIG. 1. The method 4000 is applicable to the embodiments described with reference to FIGS. 2A-B, D, and F.

At 4010, the dimmer initializes.

At 4020, the controller determines whether a configuration actuator has been actuated for a predetermined period (e.g., 5 seconds). If no, at 4025, the controller determines whether the primary intensity actuator is at a position greater than a low threshold and less than a high threshold for the predetermined period, and if yes, at 4017 the controller determines that the dimmer is in normal operation mode and then returns to 4020. In some examples, the low threshold may be 40% intensity and high threshold may be 60% intensity. In some examples, if the high threshold is set at, e.g., 30%, then the low threshold may be set any point below 30% to zero intensity. If the primary intensity actuator is not at a position greater than a low threshold and less than a high threshold for the predetermined period, then the method 4000 proceeds to 4030. If, at 4020, the controller determines that the configuration actuator has been actuated, then the method 4000 proceeds to 4030.

At 4030, the controller determines whether the primary intensity actuator is at a position higher than a high threshold value for a predetermined period. If no, at 4035 the controller determines whether the primary intensity actuator is at a position lower than a low threshold value for the predetermined period. If the primary intensity actuator is at a position lower than a low threshold value for the predetermined period, the method 4000 reverts to 4020. If, at 4030, the controller determines that the primary intensity actuator is at a position higher than a high threshold value for the predetermined period, the method 4000 continues to 4040.

At 4040, the controller determines that the dimmer is in configuration mode for high-end trimming and the method 4000 reverts to 4020.

Figure 5:
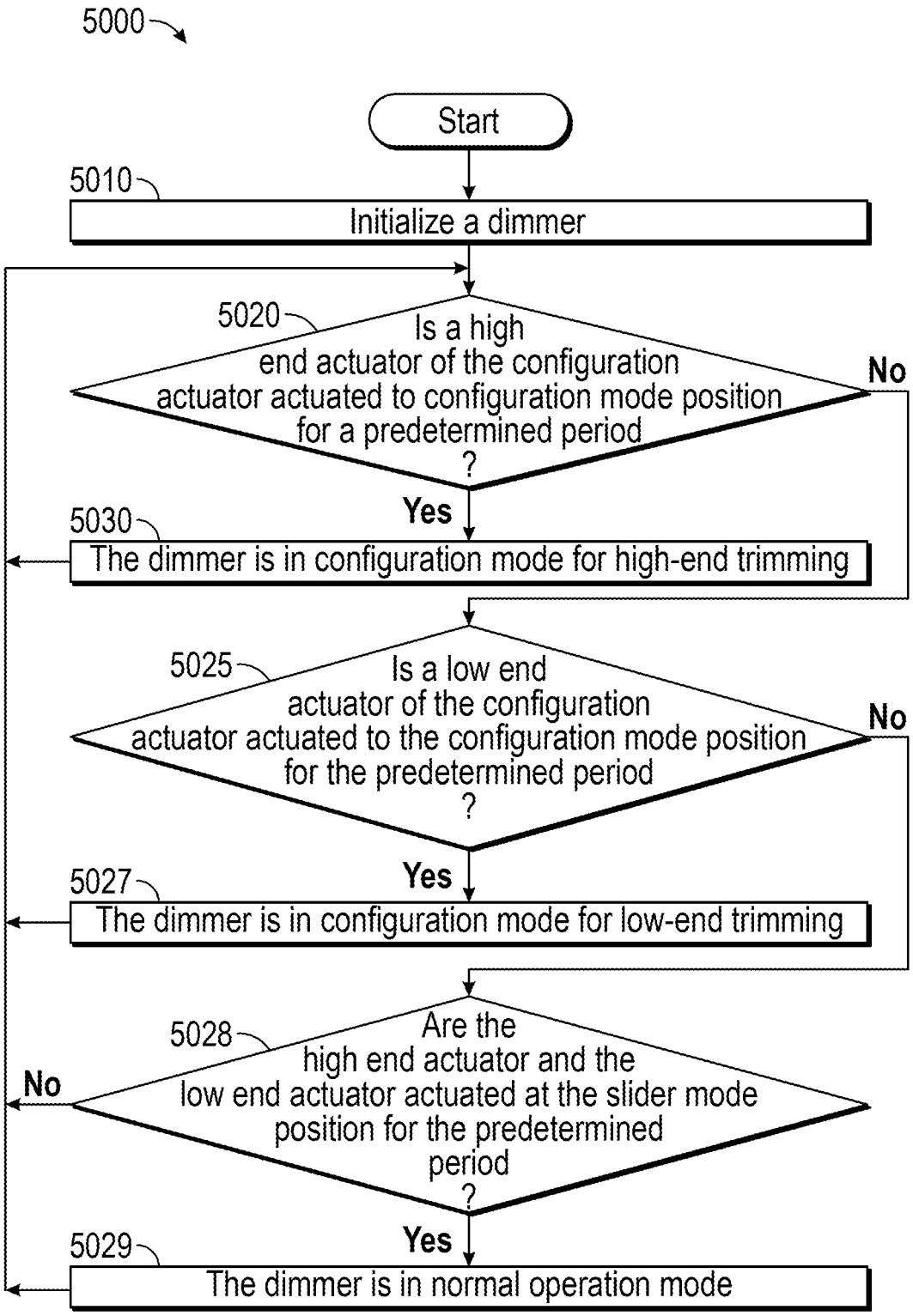
FIG. 5 is a flow chart for a method of obtaining dimmer mode in accordance with an example embodiment of the disclosed concept.

FIG. 5 is a flow chart for a method 5000 of obtaining dimmer mode in accordance with an example embodiment of the disclosed concept. The method 5000 may be performed by a user, the dimmer 1 or any components therein as described with reference to FIG. 1. The method 5000 is applicable to the embodiment described with reference to FIG. 2F or 2G, which may include a configuration actuator including a high end actuator, a low end actuator, a configuration mode position, and a slider mode position.

At 5010, the dimmer initializes.

At 5020, the controller determines whether a high end actuator of the configuration actuator is at configuration mode position for a predetermined period. If no, at 5025 the controller determines whether a low end actuator of the configuration actuator is actuated to the configuration mode position for the predetermined period. If the low end actuator is at the configuration mode, at 5027 the controller determines that the dimmer is in configuration mode for low-end trimming and the method 5000 returns to 5020. If the low end actuator is not at the configuration mode, at 5028 the controller determines whether the high end actuator and low end actuator are at the slider mode (normal operation mode) position. If the high end actuator and low end actuator are at the slider mode position, at 5029 the controller determines that the dimmer is in normal operation mode and then the method 5000 returns to 5020. If the high end actuator and the low end actuator are not at the slider mode position, the method 5000 returns to 5010. If, at 5020, the controller determines that the high end actuator is at the configuration mode position, then the method proceeds to 5030.

At 5030, the controller determines that the dimmer is in configuration mode for high-end trimming, and the method 5000 returns to 5020.

Figure 6:
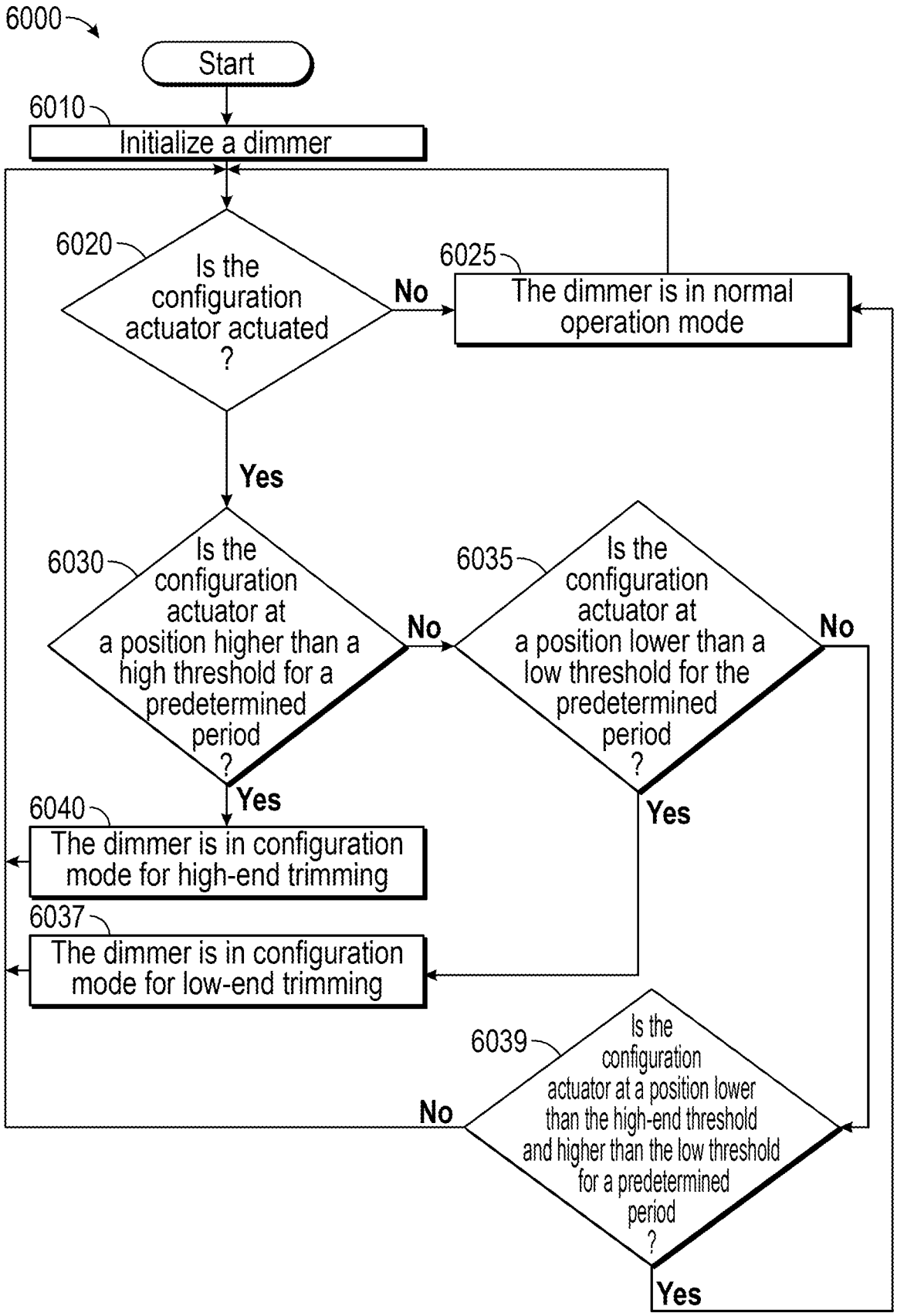
FIG. 6 is a flow chart for a method of obtaining dimmer mode an end trim value in accordance with an example embodiment of the disclosed concept.

FIG. 6 is a flow chart for a method 6000 of obtaining dimmer mode in accordance with an example embodiment of the disclosed concept. The method 6000 may be performed by a user, the dimmer 1 or any components therein as described with reference to FIG. 1. The method 6000 is applicable to the embodiment described with reference to FIG. 2C.

At 6010, the dimmer initializes.

At 6020, the controller determines whether a configuration actuator is actuated. If no, at 6025 the controller determines that the dimmer is in normal operation mode and the method 6000 returns to 6020. If yes, the method 6000 continues to 6030.

At 6030, the controller determines whether the configuration actuator is at position higher than a high threshold for a predetermined period. If no, at 6035, the controller determines whether the configuration actuator is at position lower than a low threshold for the predetermined period. If the configuration actuator is at position lower than the low threshold, at 6037 the controller determines that the dimmer is in configuration mode for low-end trimming and the method 6000 returns to 6020. If the configuration actuator is not at a position lower than a low threshold, at 6039 the controller determines whether the configuration actuator is at a position lower than the high threshold and higher than the low threshold for the predetermined period, and if yes, the method 6000 returns to 6025 and then to 6020. If the configuration actuator is not at a position lower than the high threshold and higher than the low threshold for the predetermined period, the method 6000 returns to 6020. If, at 6030, the configuration actuator is at the position higher than the high threshold, the method 600 proceeds to 6040.

At 6040, the controller determines that the dimmer is in configuration mode for high-end trimming.

Figure 7:
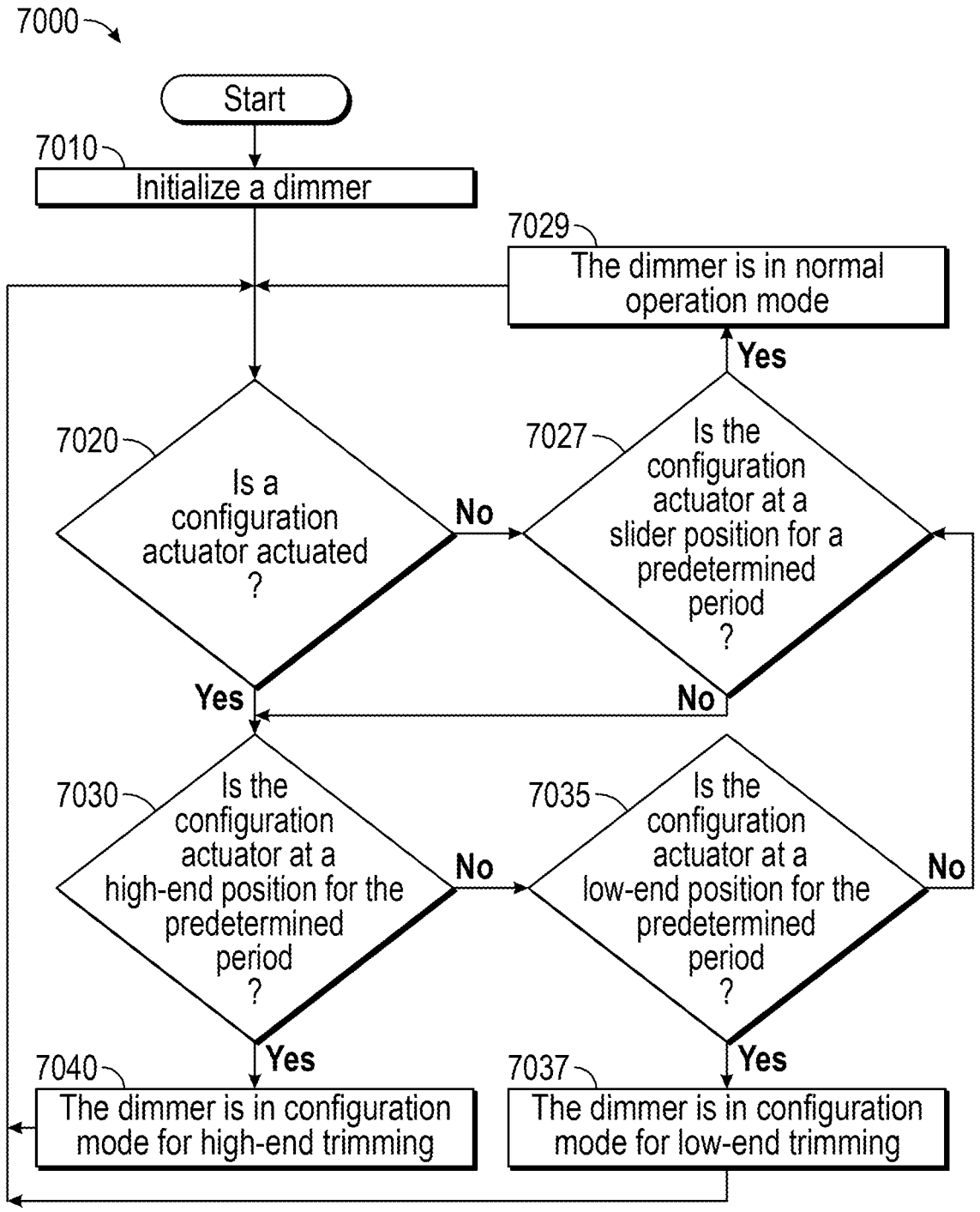
FIG. 7 is a flow chart for a method of obtaining dimmer mode in accordance with an example embodiment of the disclosed concept.

FIG. 7 is a flow chart for a method 7000 of obtaining dimmer mode in accordance with an example embodiment of the disclosed concept. The method 7000 may be performed by a user, the dimmer 1 or any components therein as described with reference to FIG. 1. The method 7000 is applicable to the embodiment described with reference to FIG. 2G. A configuration actuator may include a three position switch including a high end position, a low end position, and a slider (normal operation) position.

At 7010, the dimmer initializes.

At 7020, the controller determines whether a configuration actuator is actuated. If no, at 7027 the controller determines whether the configuration actuator is at a slider position for a predetermined period. If yes, at 7029 the controller determines that the dimmer is in normal operation mode. If no, the method 7000 proceeds to 7030. If, at 720 the configuration actuator is actuated, the method 7000 proceeds to 7030.

At 7030, the controller determines whether the configuration actuator is at a high-end position for the predetermined period. If not, at 7035 the controller determines whether the configuration actuator is at a low end position for the predetermined period, and if no, the method 7000 returns to 7027. If yes, at 7037 the controller determines that the dimmer is in the configuration mode for low-end trimming. If, at 7030, controller determines that the configuration actuator is at a high-end position for the predetermined period, the method 7000 proceeds to 7040.

At 7040, the controller determines that the dimmer is in configuration mode for high-end trimming and the method 7000 returns to 7020.

Figure 8:
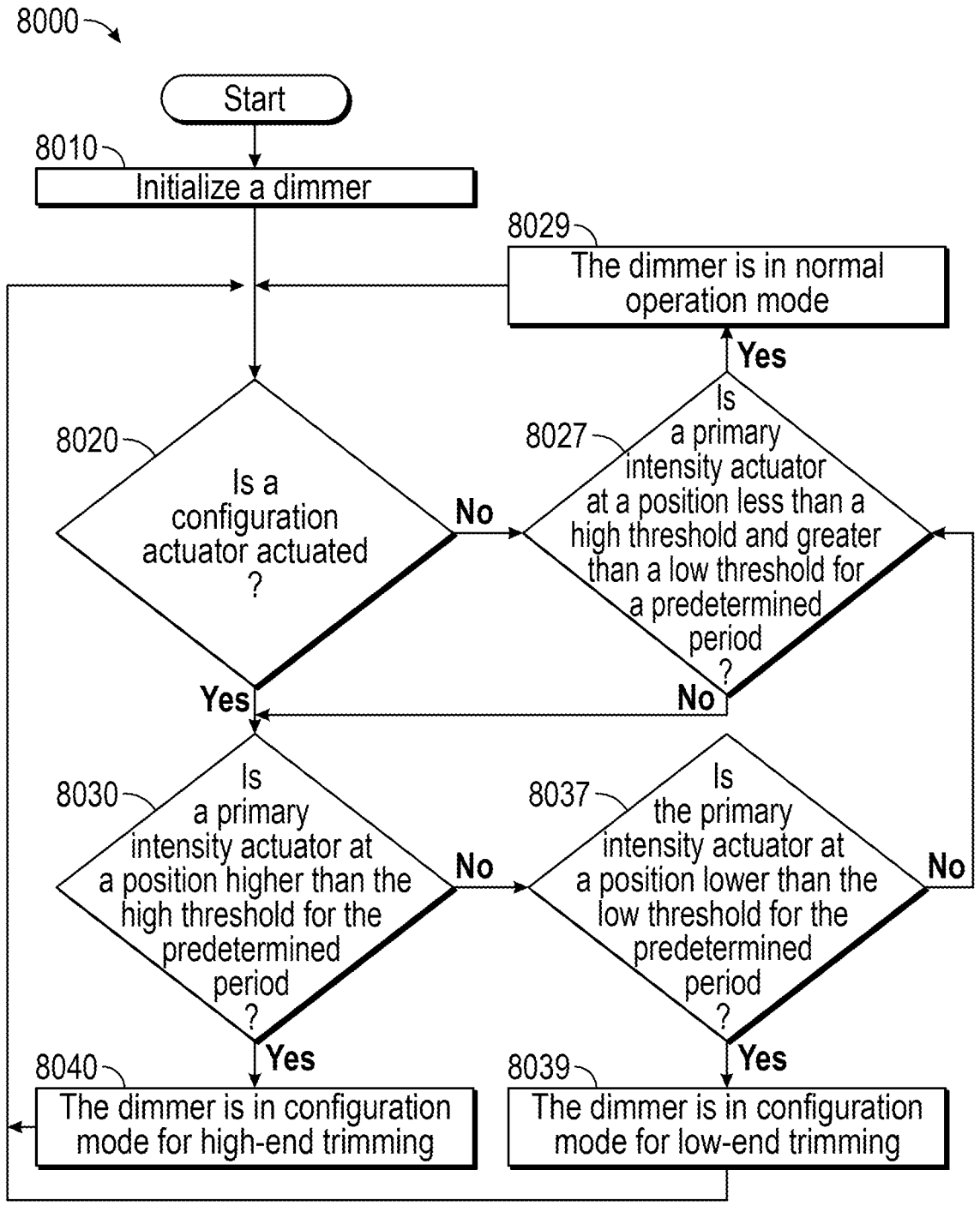
FIG. 8 is a flow chart for a method of obtaining dimmer mode in accordance with an example embodiment of the disclosed concept.

FIG. 8 is a flow chart for a method 800 of obtaining dimmer mode in accordance with an example embodiment of the disclosed concept. The method 8000 may be performed by a user, the dimmer 1 or any components therein as described with reference to FIG. 1. The method 8000 is applicable to the embodiment described with reference to FIG. 2E. A configuration actuator may include a dual push button including an increase actuator and a decrease actuator.

At 8010, the dimmer initializes.

At 8020, the controller determines whether a configuration actuator is actuated. If no, at 8027, the controller determines whether a primary intensity actuator at a position less than a high threshold and greater than a low threshold for a predetermined period. If the primary intensity actuator is at a position less than the high threshold and greater than the low threshold, at 8029 the controller determines that the dimmer is in normal operation mode. If the primary intensity actuator is not at a position less than the high threshold and greater than the low threshold, the method 8000 proceeds to 8030. If, at 8020, the controller determines that the configuration actuator is actuated, the method 8000 proceeds to 8030.

At 8030, the controller determines whether the primary intensity actuator is at a position greater than the high threshold for the predetermined period. If no, at 8037 the controller determines whether the primary intensity actuator is at a position lower than the high threshold for the predetermined period. If the controller determines that the primary intensity actuator is at a position lower than the high threshold for the predetermined period, at 8039 the controller determines that the dimmer is in configuration mode for low-end trimming. If the controller determines that the primary intensity actuator is not at a position lower than the high threshold for the predetermined period, the method 8000 returns to 8027. If, at 8030, the controller determines that the primary intensity actuator is at a position greater than the high threshold for the predetermined period, the method 8000 proceeds to 8040.

At 8040, the controller determines that the dimmer is in configuration mode for high-end trimming, and the method 8000 returns to 8020.

Figure 9:
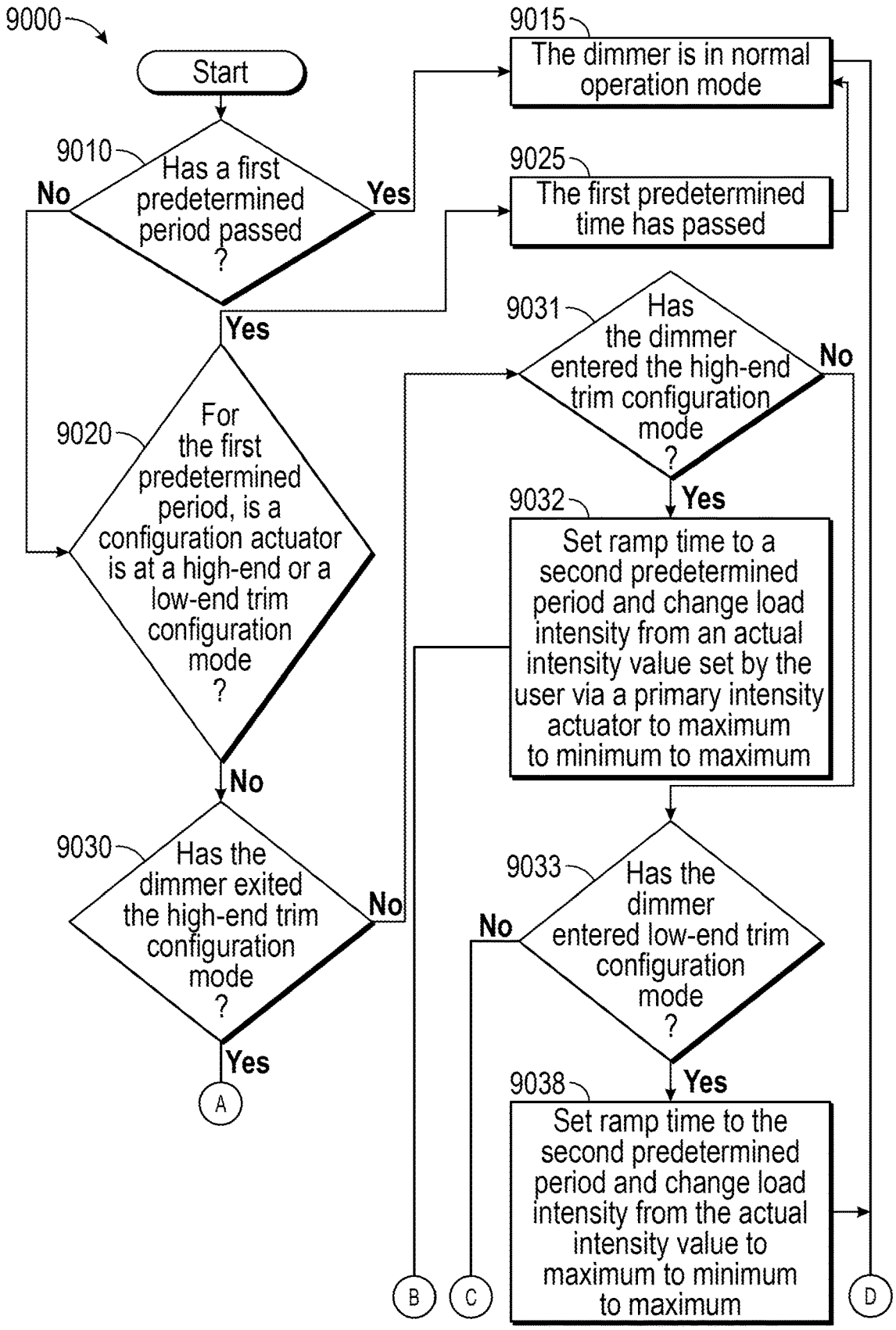
FIG. 9 is a flow chart for a method of adjusting end trim values in accordance with an example embodiment of the disclosed concept.
Figure 9:
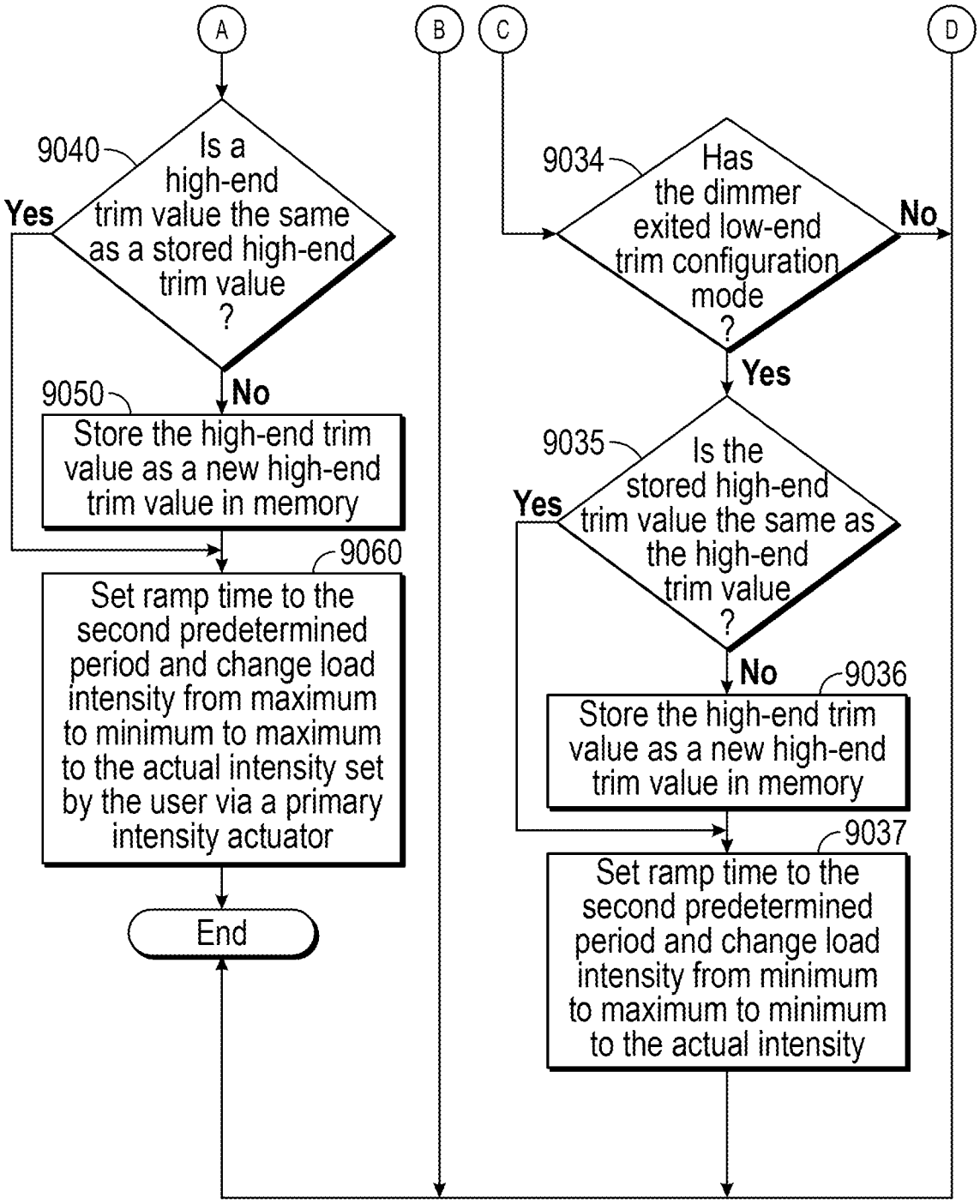

FIG. 9 is a flow chart for a method 900 of adjusting end trim values in accordance with an example embodiment of the disclosed concept. The method 9000 may be performed by a user, the dimmer 1 or any components therein as described with reference to FIG. 1.

At 9010, the controller determines whether a first predetermined time has passed. If yes, at 9015 the controller determines that the dimmer is in normal operation mode. If no, the method 9000 proceeds to 9020.

At 9020, the controller determines whether for the first predetermined period a configuration actuator is at a high-end or low-end trim configuration mode. If yes, at 9025, the controller determines that the first predetermined period has passed, and the method 9000 returns to 9015. If no, the method 9000 proceeds to 9030.

At 9030, the controller determines whether the dimmer has exited the high-end trim configuration mode. If no, at 9031 the controller determines whether the dimmer has entered the high-end configuration mode. If the dimmer has entered the high-end trim configuration mode, at 9032 the controller sets ramp time to a second predetermined period and change load intensity, e.g., without limitation, from an actual high intensity value set by the user via a primary intensity actuator to maximum, to minimum, then to maximum. If the dimmer has not entered the high-end trim configuration mode, at 9033 the controller determines whether the dimmer has entered a low-end trim configuration mode. If the dimmer has entered the low-end trim configuration mode, at 9038 the controller sets ramp time to the second predetermined period and change load intensity, e.g., without limitation, from an actual low intensity value set by the user via a primary intensity actuator to maximum, to minimum, then to maximum. If the dimmer t has not entered the low-end trim configuration mode, at 9034 the controller determines whether the dimmer has exited low-end trim configuration mode. If the dimmer has exited the low-end trim configuration mode, at 9035 the controller determines whether the stored high-end trim value is the same as the high-end trim value and if no, the method 9000 ends. If the stored high-end trim value is the same as the high-end trim value, at 9037 the controller sets ramp time to the second predetermined period and change load intensity, e.g., without limitation, from minimum, to maximum, then to minimum to the actual intensity value set by the user, and then the method 9000 ends. If the stored high-end trim value is not the same as the high-end trim value, at 9036 the controller stores the high-end trim value as the new high-end trim value in memory and the method 9000 proceeds to 9037. If, at 9030, the controller determines that the dimmer has exited the high-end trim configuration mode, at 9040 the controller determines whether the high-end trim value is the same as the stored high-end trim value. If the controller determines that the high-end trim value is not the same as the stored high-end trim value, at 9050 the controller stores the high-end trim value as the new high-end trim value and the method 9000 proceeds to 9060. If, at 9040 the controller determines that the high-end trim value is the same as the stored high-end trim value, the method 9000 proceeds to 9060. At 9060, the controller sets ramp time to the second predetermined period and change load intensity, without limitation, from maximum to minimum, then to maximum and then to the actual intensity value set by the user via the primary intensity actuator, and then the method 9000 ends. It is noted that these changes in the load intensity in the aforementioned sequences are exemplary only and not limiting, and thus, the visual indication for entering or exiting the configuration modes may be corresponsive to other ramping sequences.

Figure 10:
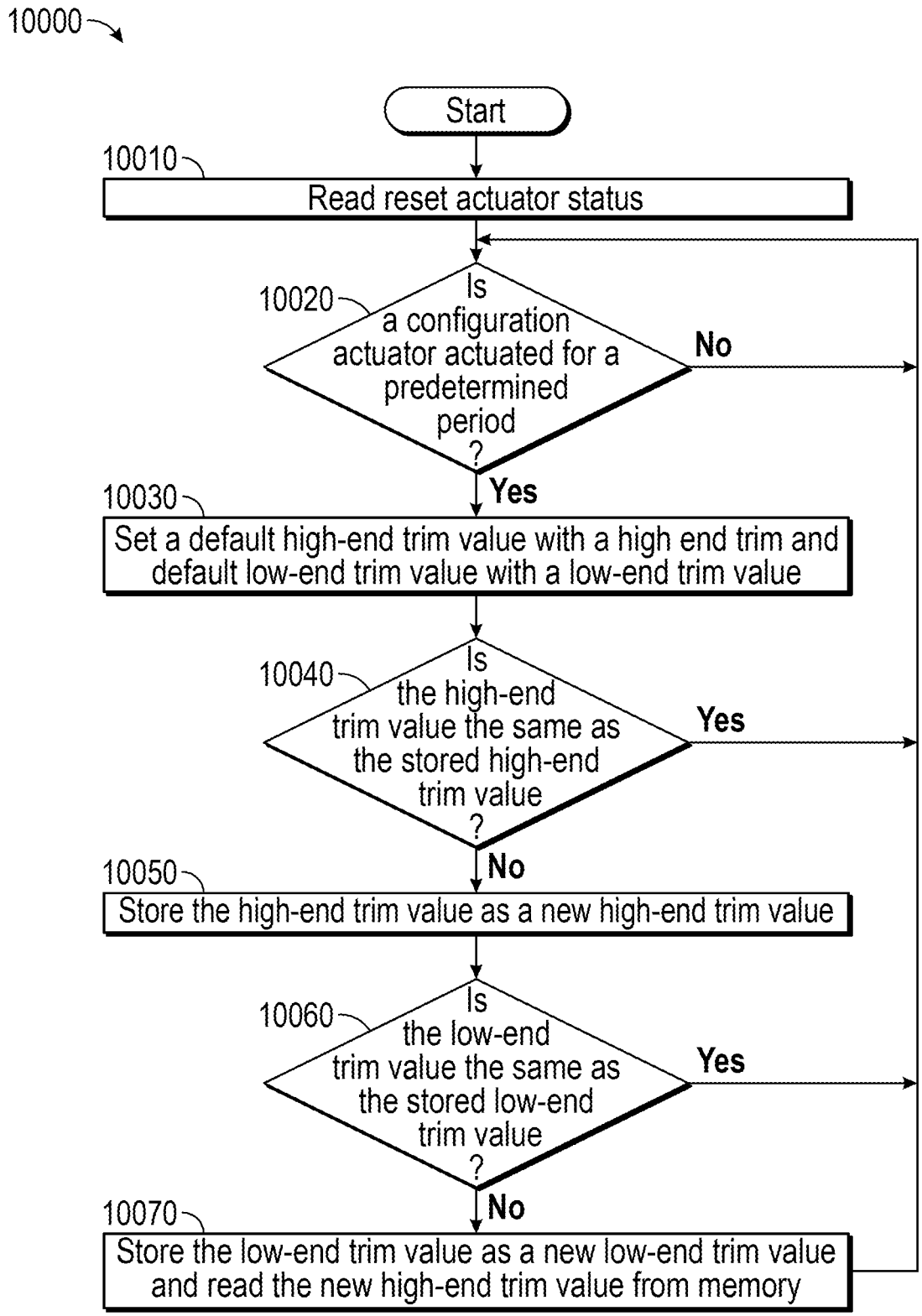
FIG. 10 is a flow chart for a method of adjusting end trim values in accordance with an example embodiment of the disclosed concept.

FIG. 10 is a flow chart for a method 10000 of adjusting end trim values in accordance with an example embodiment of the disclosed concept. The method 10000 may be performed by a user, the dimmer 1 or any components therein as described with reference to FIG. 1. The method 10000 is applicable to the embodiment as described with reference to FIG. 2F, in which the configuration actuator includes a configuration mode actuator and a reset actuator.

At 10010, the controllers reads reset actuator status.

At 10020, the controller determines whether the configuration mode actuator is actuated for a predetermined period. If no, the method 10000 repeats 10020. If yes, the method 10000 proceeds to 10030.

At 10030, the controller sets a default high-end trim value with a high-end trim value and a default low-end trim value with a low-end trim value.

At 10040, the controller determines whether the high-end trim value is the same as the stored high-end trim value. If yes, the method 10000 returns to 10020. If no, the method 10000 continues to 10050.

At 10050, the controller stores the high-end trim value as a new high-end trim value.

At 10060, the controller determines whether the low-end trim value is the same as a stored low-end trim value. If yes, the method 10000 returns to 10020. If no, the method 10000 proceeds to 10070.

At 10070, the controller stores the low-end trim value as a new low-end trim value and read the new high-end trim value from the memory, and then the method 10000 returns to 10020.

Figure 11:
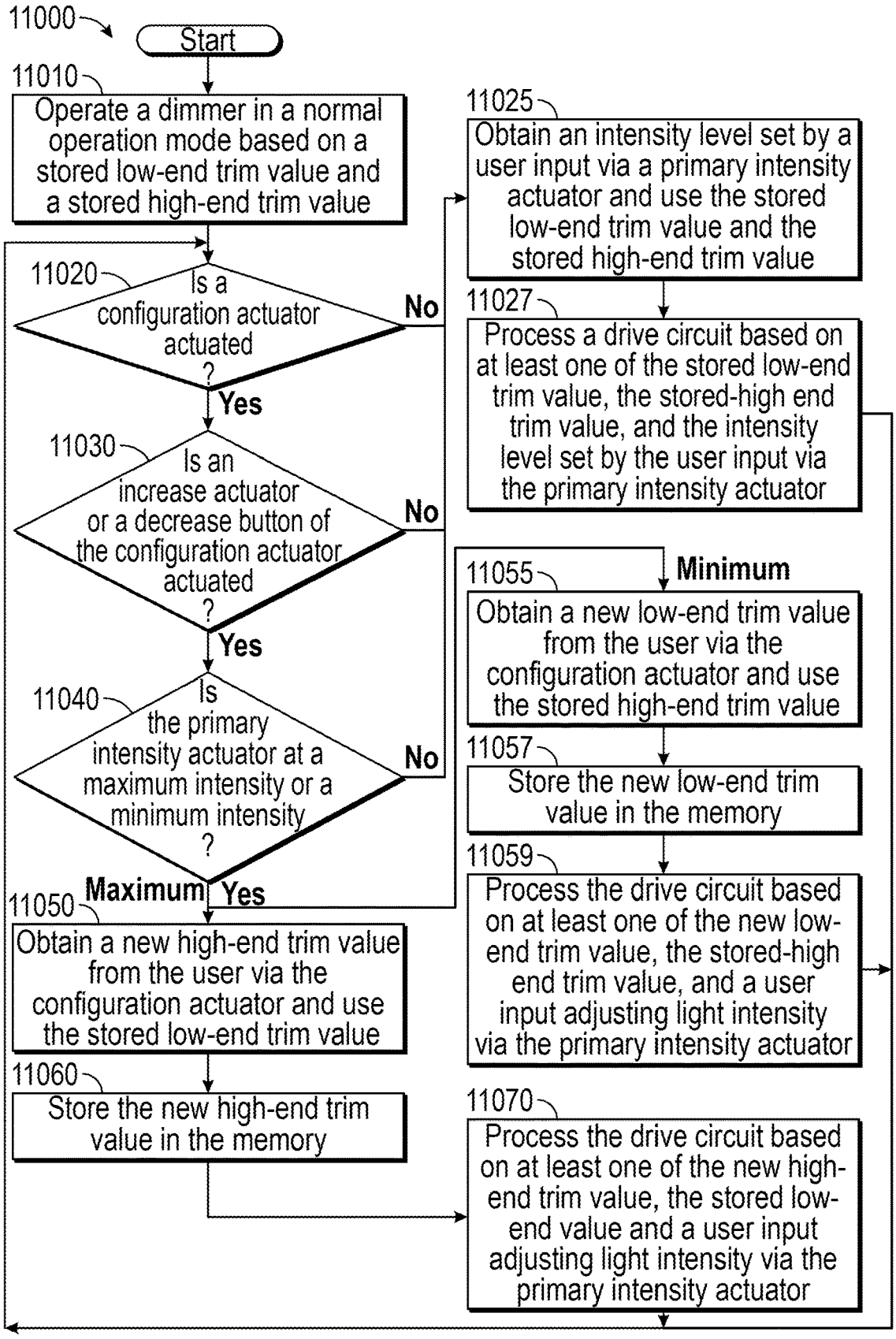
FIG. 11 is a flow chart for a method of adjusting end trim values in accordance with an example embodiment of the disclosed concept.

FIG. 11 is a flow chart for a method 11000 of adjusting end trim values in configuration mode in accordance with an example embodiment of the disclosed concept. The method 11000 may be performed by a user, the dimmer 1 or any components therein as described with reference to FIG. 1. The method 11000 is applicable to the embodiment as described with reference to FIGS. 2D-E, in which the configuration actuator includes three push actuators including an increase actuator, a decrease actuator and a configuration mode actuator, or a dual push actuator including an increase actuator and a decrease actuator.

At 11010, the controller operates a dimmer in a normal operation mode based on a stored low-end trim value and a stored high-end trim value.

At 11020, the controller determines whether a configuration actuator is actuated. If no, at 11025 the controllers obtains an intensity level set by a user via a primary intensity actuator and use the stored low-end trim value and the stored high-end trim value, and at 11027 the controller processes a drive circuit based on at least one of the stored low-end trim value, the stored high-end trim value, and the intensity level set by the user via the primary intensity actuator, and then the method 11000 reverts to 11020. If yes, the method 11000 proceeds to 11030.

At 1130, the controller determines whether an increase actuator or a decrease actuator is actuated. If no, the method 1100 returns to 1125. If yes, the method 1100 proceeds to 11040.

At 11040, the controller determines whether a primary intensity actuator is at a maximum intensity or minimum intensity. If no, the method 11000 returns to 11025. If yes and the primary intensity actuator is at the maximum intensity, the method 11000 proceeds to 11050. If yes and the primary intensity actuator is at the minimum intensity, the method 11000 proceeds to 11055. At 11055, the controller obtains a new low-end trim value from the user via the configuration actuator and use the stored high-end trim value. At 11057, the controller stores the new low-end trim value in the memory, and at 11059 the controller processes the driver circuit based on at least one of the new low-end trim value, the stored high-end trim value, and the user input adjusting light intensity via the primary intensity actuator, and then the method 11000 reverts to 11020.

At 11050, the controller obtains a new high-end trim value from the user via the configuration actuator and use the stored low-end trim value.

At 11060, the controller stores the new high-end trim value in the memory.

At 11070, the controller processes the drive circuit based on at least one of the new high-end trim value, the stored low-end trim value, and a user input adjusting light intensity via the primary intensity actuator, and then the method reverts to 11020.

Figure 12:
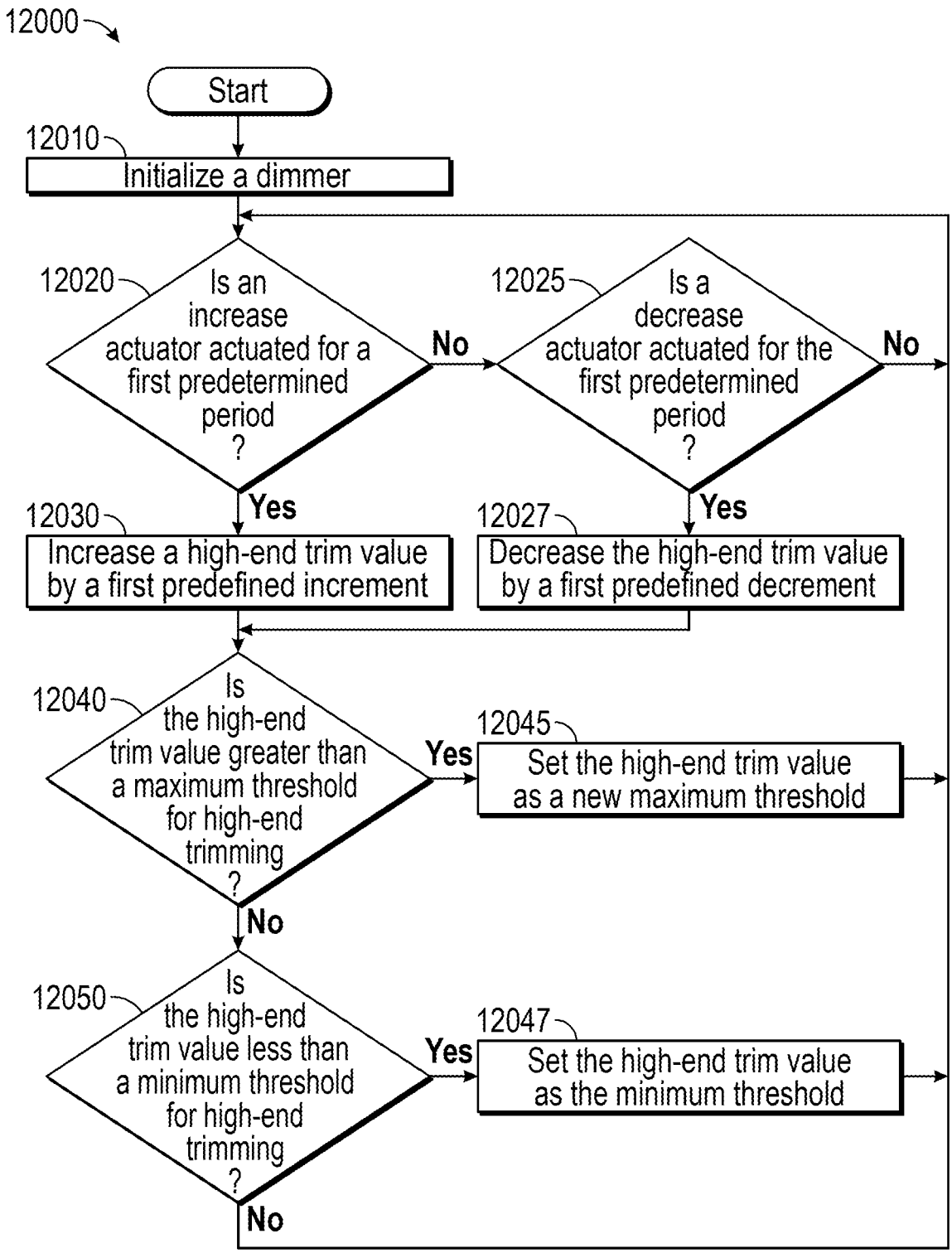
FIG. 12 is a flow chart for a method of adjusting high-end trim value in accordance with an example embodiment of the disclosed concept.

FIG. 12 is a flow chart for a method 12000 of adjusting high-end trim value in configuration mode in accordance with an example embodiment of the disclosed concept. The method 12000 may be performed by a user, the dimmer 1 or any components therein as described with reference to FIG. 1. The method 12000 is applicable to the embodiment as described with reference to FIGS. 2D-E, in which the configuration actuator includes three push actuators including an increase actuator, a decrease actuator and a configuration mode actuator, or a dual push actuator including an increase actuator and a decrease actuator.

At 12010, the dimmer initializes.

At 12020, the controller determines whether an increase actuator is actuated for a first predetermined period. If no, at 12025 the controller determines whether a decrease actuator is actuated for the first predetermined period. If at 12025 the controller determines that a decrease actuator is actuated for the first predetermined period, at 12027, the controller decreases the high-end trim value by a first predefined decrement, and the method 12000 proceeds to 1240. If, at 12025, the controller determines that a decrease actuator is not actuated for the first predetermined period, the method 12000 returns to 12020. If, at 12020, the controller determines that an increase actuator is actuated for a first predetermined period, the method 12000 proceeds to 12030.

At 12030, the controllers increases a high-end trim value by a first predefined increment.

At 12040, the controller determines whether the high-end trim value is greater than a maximum threshold for high-end trimming. If yes, at 12045 the controllers sets the high-end trim value as a new maximum threshold, and the method 12000 returns to 12020. If no, the method 12000 proceeds to 12050.

At 12050, the controller determines whether the high-end trim value is less than a minimum threshold for high-end trimming. If yes, the controllers sets the high-end trim value as a new minimum threshold and the method 12000 returns to 12020. If no, the method 12000 ends.

Figure 13:
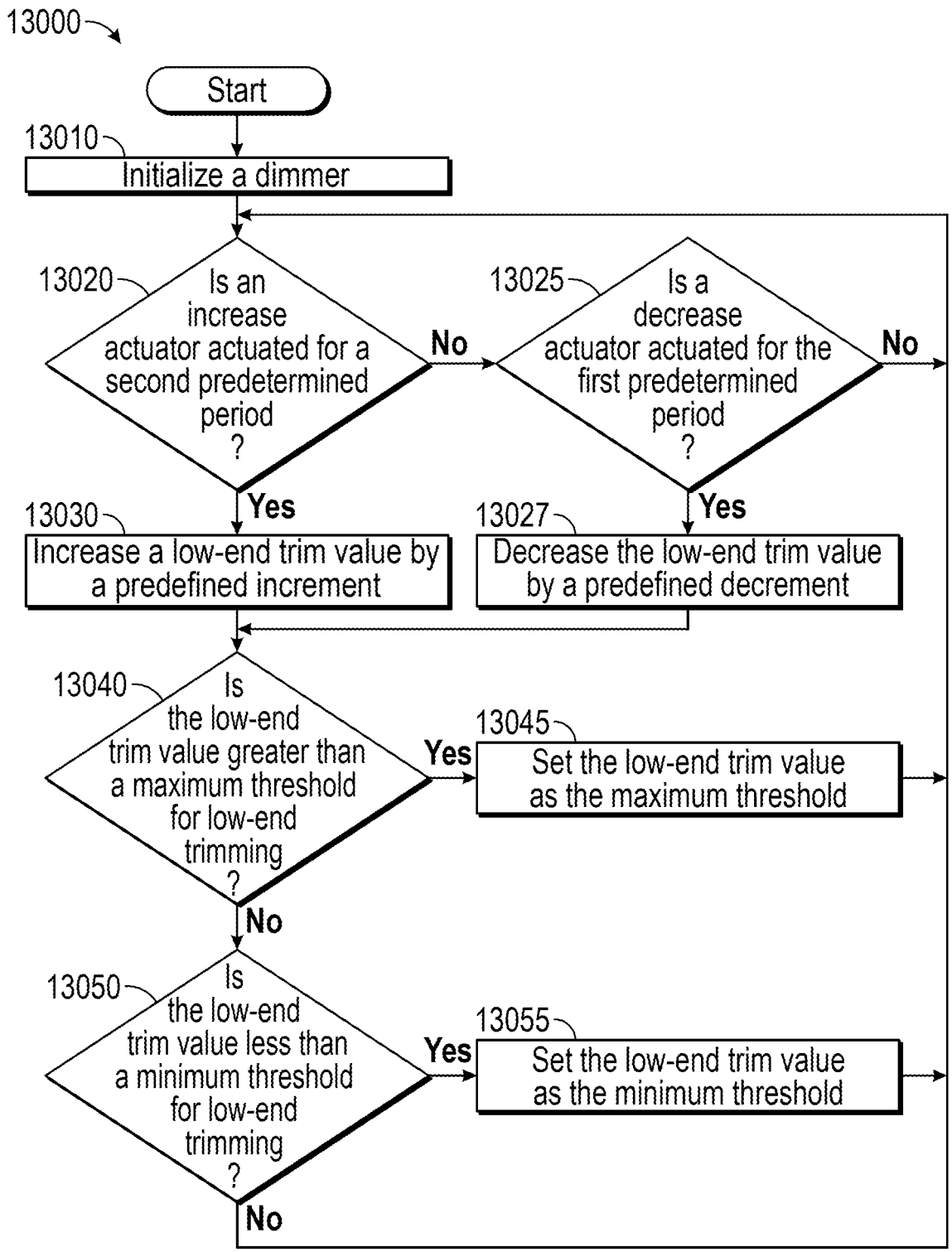
FIG. 13 is a flow chart for a method of adjusting low-end trim value in accordance with an example embodiment of the disclosed concept.

FIG. 13 is a flow chart for a method 13000 of adjusting low-end trim value in accordance with an example embodiment of the disclosed concept. The method 13000 may be performed by a user, the dimmer 1 or any components therein as described with reference to FIG. 1. The method 13000 is applicable to the embodiment as described with reference to FIGS. 2D-E, in which the configuration actuator includes three push actuators including an increase actuator, a decrease actuator and a configuration mode actuator, or a dual push actuator including an increase actuator and a decrease actuator.

At 13010, the dimmer initializes.

At 13020, the controller determines whether an increase actuator is actuated for a first predetermined period. If no, at 13025 the controller determines whether a decrease actuator is actuated for the first predetermined period. If at 13025 the controller determines that a decrease actuator is actuated for the first predetermined period, at 13027 the controller decreases the low-end trim value by a second predefined decrement, and the method 13000 proceeds to 13040. If at 13025 the controller determines that a decrease actuator is not actuated for the first predetermined period, the method 13000 returns to 13020. If at 13020, the controller determines that the increase actuator is actuated for a first predetermined period, the method 13000 proceeds to 13030.

At 13030, the controller increases a low-end trim value by a second predefined increment.

At 13040, the controller determines whether the low-end trim value is greater than a maximum threshold for low-end trimming. If yes, the controllers sets the low-end trim value as a new maximum threshold. If no, the method 13000 proceeds to 13050.

At 13050, the controller determines whether the low-end trim value is less than a minimum threshold for low-end trimming. If yes, the controllers sets the low-end trim value as a new minimum threshold. If no, the method 13000 returns to 13020.

Figure 14:
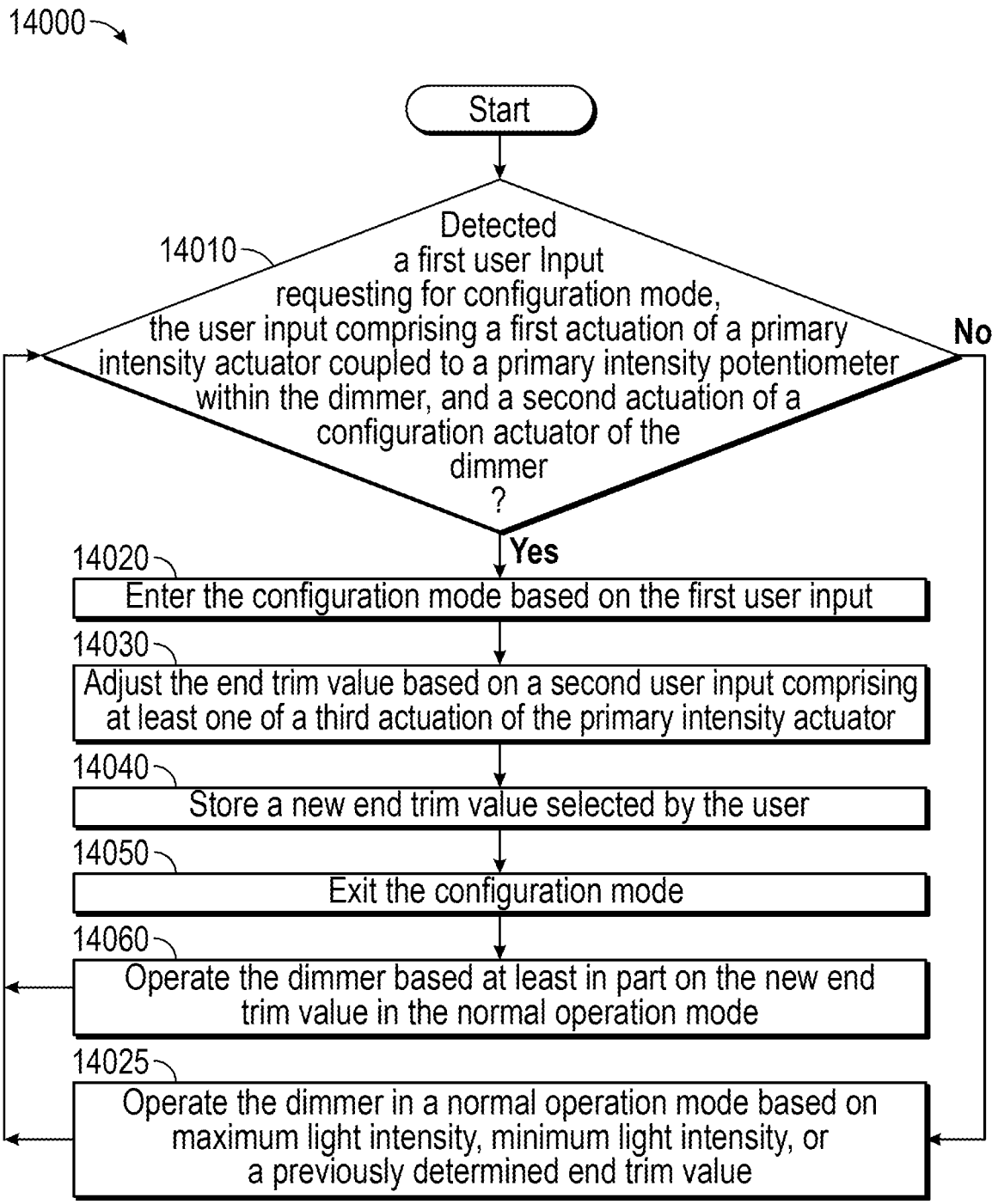
FIG. 14 is a flow chart for a method of adjusting end trim values in accordance with an example embodiment of the disclosed concept.

FIG. 14 shows a flowchart for a method for adjusting end trim values in accordance with an example embodiment of the disclosed concept. The method 14000 may be performed by a user, the dimmer 1 or any components therein as described with reference to FIG. 1.

At 14010, the controller determines whether it has detected a first user input requesting for configuration mode, the first user input comprising a first actuation of a primary intensity actuator coupled to a primary intensity potentiometer within the dimmer, and a second actuation of a configuration actuator of the dimmer. If no, at 14025 the controller operates the dimmer in a normal operation mode based on maximum light intensity, minimum light intensity or a previously determined end trim value and the method 14000 proceeds to 14020. If yes, the method 14000 proceeds to 14020.

At 14020, the dimmer enters the configuration mode based on the first user input.

At 14030, the dimmer adjusts the end trim value based on a second user input comprising at least one of a third actuation of the primary intensity actuator.

At 14040, the controller stores a new end trim value selected by the user.

At 14050, the dimmer exits the configuration mode.

At 14060, the dimmer operates based at least in part on the new end trim value in the normal operation mode and the method 14000 returns to 14020.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dimmer comprising:

a primary intensity actuator coupled to a primary intensity potentiometer, the primary intensity actuator structured to be actuated for at least one of:

controlling an amount of power delivered to a load connected to the dimmer between minimum amount and maximum amount of power in normal operation mode, and adjusting light intensity based on a first user input in the normal operation mode;

selecting a type of end trimming based on a second user input before entering configuration mode; or adjusting, based on a third user input, an end trim value during the configuration mode;

a configuration actuator arranged on a side of the dimmer and structured to be actuated for entering the configuration mode based on a fourth user input within a first predetermined period; and a controller coupled to the primary intensity potentiometer, the configuration actuator, and a driver circuit coupled to a bidirectional switching device, the controller structured to control dimmer operation comprising receiving a voltage signal based on variable resistance from the primary intensity potentiometer, receiving a mode selection signal from the configuration actuator, and transmitting a dimming signal to the driver circuit for driving the bidirectional switching device, the dimming signal based at least in part on the voltage signal, wherein the end trim value comprises at least one of a low-end trim value or a high-end trim value;

wherein the type of end trimming comprises at least one of a low-end trimming or a high-end trimming;

wherein the second input comprises:

actuating the primary intensity actuator above a high threshold for high-end trimming; or actuating the primary intensity actuator below a low threshold for low-end trimming, and wherein the third input comprises:

actuating the primary intensity actuator to a new high-end value for high-end trimming; or actuating the primary intensity actuator to a new low-end value for low-end trimming.

2. The dimmer of claim 1, wherein the configuration actuator is a single push button, and the fourth user input comprises actuating the single push button.

3. The dimmer of claim 1, wherein the configuration actuator is a two position switch comprising a configuration mode position and a normal operation mode position, and the fourth user input comprises actuating the two position switch to the configuration mode position.

4. The dimmer of claim 1, wherein the configuration actuator is a thumb wheel comprising a configuration mode position and a normal operation mode position, and the fourth user input comprises actuating the thumb wheel to the configuration mode position, the thumb wheel being coupled to a secondary potentiometer.

5. The dimmer of claim 4, wherein the voltage signal for the configuration mode indicates a voltage greater than a predetermined voltage, and the voltage signal for the operation mode indicates a voltage less than the predetermined voltage.

6. The dimmer of claim 1, wherein the configuration actuator is three push buttons comprising a configuration mode button, an increase button, and a decrease button, the fourth user input comprises actuating the configuration mode button, and at least one of;

actuating the increase button to increase the end trim value by a predetermined increment size; or actuating the decrease button to decrease the end trim value by a predetermined decrement size.

7. The dimmer of claim 1, wherein the configuration actuator is a dual push button including an increase position and a decrease position, and the fourth input comprises actuating the dual push button at the increase position or the decrease position, wherein actuating the increase button increases the end trim value by a predetermined increment size; and actuating the decrease button decreases the end trim value by a predetermined decrement size.

8. The dimmer of claim 1, wherein the configuration actuator is two push buttons including a configuration mode button and a reset button for resetting the dimmer, and the fourth user input comprises actuating the configuration mode button.

9. The dimmer of claim 1, wherein the configuration actuator is a three position switch comprising a high end position, a normal operation position, and a low end position, and the fourth input comprises at least one of:

actuating the high end position of the three position switch for high-end trimming; or actuating the low end position of the three position switch for low-end trimming.

10. The dimmer of claim 1, wherein entering the configuration mode comprises a first visual indication comprising changing the light intensity of the load in a first sequence comprising:

ramping down the load to the minimum light intensity;

ramping up the load to the maximum light intensity; and ramping down the load to the minimum light intensity.

11. The dimmer of claim 1, wherein adjusting the low-end trim value comprises:

upon a lapse of a second predefined period immediately following the actuation of the third user input, storing the new low-end trim value in a memory;

exiting the configuration mode; and operating based at least in part on the new low-end trim value in the normal operation mode.

12. The dimmer of claim 11, wherein exiting the configuration mode comprises a second visual indication comprising changing the light intensity of the load in a second sequence comprising:

ramping down the load to the minimum light intensity;

ramping up the load to the maximum light intensity;

ramping down the load to the minimum light intensity; and ramping up the load to the new low-end trim value selected by the user.

13. The dimmer of claim 1, wherein adjusting the high-end trim value comprises:

upon a lapse of a third predefined period following the actuation of the third user input, storing the new high-end trim value in memory;

exiting the configuration mode; and operating based at least in part on the new high-end trim value in the normal operation mode.

14. The dimmer of claim 13, wherein entering the configuration mode comprises a third visual indication comprising changing the light intensity of the load in a third sequence comprising:

ramping down the load to the minimum light intensity; and ramping up the load to the maximum light intensity.

15. The dimmer of claim 14, wherein exiting the configuration mode comprises a fourth visual indication comprising changing the light intensity of the load in a fourth sequence comprising:

ramping up the load to the maximum light intensity;

ramping down the load to the minimum light intensity;

ramping up the load to the maximum light intensity; and ramping down the load to the new high-end trim value selected by the user.

16. The dimmer of claim 1, wherein the controller is further structured to store the new end trim value in a memory such that the controller controls the dimmer operation without continuously monitoring an analog to digital converter pin for sensing the first user input, the second user input, the third user input, or the fourth user input.

17. The dimmer of claim 1, wherein the first user input comprises actuating the primary intensity actuator based on the maximum light intensity, the minimum light intensity, or a predetermined end trim value.

18. A dimmer system, comprising a load;

a hot conductor electrically coupled to a power source;

a load conductor electrically coupled to the load; and a dimmer electrically coupled to the hot conductor and the load conductor, the dimmer comprising:

a primary intensity actuator coupled to a primary intensity potentiometer, the primary intensity actuator structured to be actuated for at least one of:

controlling an amount of power delivered to a load connected to the dimmer between minimum amount and maximum amount of power in normal operation mode;

adjusting light intensity based on a first user input in the normal operation mode;

selecting a type of end trimming based on a second user input before entering configuration mode; or adjusting, based on a third user input, an end trim value during the configuration mode;

a configuration actuator arranged on a side of the dimmer and structured to be actuated for entering configuration mode for end trimming based on a fourth user input within a first predetermined period; and a controller coupled to the primary intensity potentiometer, the configuration actuator, and a driver circuit coupled to a bidirectional switching device, the controller structured to control dimmer operation, comprising receiving a voltage signal based on variable resistance from the primary intensity potentiometer, receiving a mode selection signal from the configuration actuator, and transmitting a dimming signal to the driver circuit for driving the bidirectional switching device, the dimming signal based at least in part on the voltage signal, wherein the end trim value comprises at least one of a low-end trim value or a high-end trim value, wherein the type of end trimming comprises at least one of a low-end trimming or a high-end trimming, wherein the second input comprises:

actuating the primary intensity actuator above a high threshold for high-end trimming; or actuating the primary intensity actuator below a low threshold for low-end trimming, and wherein the third input comprises:

actuating the primary intensity actuator to a new high-end value for high-end trimming; or actuating the primary intensity actuator to a new low-end value for low-end trimming.

19. A method for adjusting an end trim value of a dimmer, comprising:

determining whether a first user input requesting for configuration mode is detected, the first user input comprising a first actuation of a primary intensity actuator coupled to a primary intensity potentiometer within the dimmer and a second actuation of a configuration actuator of the dimmer; and based on a determination that the first user input is detected, entering the configuration mode, adjusting an end trim value based on a second user input comprising a third actuation of the primary intensity actuator, storing a new end trim value selected by the user, exiting the configuration mode, and operating the dimmer based at least in part on the new end trim value in a normal operation mode, or based on a determination that the first user input requesting for the configuration mode is not detected, operating the dimmer in the normal operation mode based on maximum light intensity, minimum light intensity, or a previously determined end trim value, wherein the end trim value comprises a low-end trim value, the first actuation comprises actuating the primary intensity actuator below low threshold, the third actuation comprises actuating the primary intensity actuator to a position indicative of a new low-end trim value selected by the user, and the method further comprises:

indicating that the dimmer has entered the configuration mode, wherein the indication comprises changing the light intensity of a load in a first sequence comprising:

a. ramping down the load to the minimum light intensity;

b. ramping up the load to the maximum light intensity; and c. ramping down the load to the minimum light intensity.

20. The method of claim 19, wherein the method further comprises:

indicating that the dimmer has exited the configuration mode, wherein the indication comprises changing the light intensity of the load in a second sequence comprising:

a. ramping down the load to the minimum light intensity;

b. ramping up the load to the maximum light intensity;

c. ramping down the load to the minimum light intensity; and d. ramping up the load to the new low-end trim value selected by the user.

21. The method of claim 19, wherein the second user input further comprises a fourth actuation of the configuration actuator comprising at least one of an increase actuator for increasing the end trim value by a predetermined increment size or a decrease actuator for decreasing the end trim value by a predetermined decrement size.

22. A method for adjusting an end trim value of a dimmer, comprising:

determining whether a first user input requesting for configuration mode is detected, the first user input comprising a first actuation of a primary intensity actuator coupled to a primary intensity potentiometer within the dimmer and a second actuation of a configuration actuator of the dimmer; and based on a determination that the first user input is detected, entering the configuration mode, adjusting an end trim value based on a second user input comprising a third actuation of the primary intensity actuator, storing a new end trim value selected by the user, exiting the configuration mode, and operating the dimmer based at least in part on the new end trim value in a normal operation mode, or based on a determination that the first user input requesting for the configuration mode is not detected, operating the dimmer in the normal operation mode based on maximum light intensity, minimum light intensity, or a previously determined end trim value, wherein the end trim value comprises a high-end trim value, the first actuation comprises actuating the primary intensity actuator above high threshold, and the third actuation comprises actuating the primary intensity actuator to a new high-end trim value selected by the user, and the method further comprises:

indicating that the dimmer has entered the configuration mode, wherein the indication comprises changing the light intensity of the load in a third sequence comprising:

a. ramping down the load to the minimum light intensity; and b. ramping up the load to the maximum light intensity.

23. The method of claim 22, wherein the method further comprises:

indicating that the dimmer has exited the configuration mode, wherein the indication comprises changing the light intensity of the load in a fourth sequence comprising:

a. ramping up the load to the maximum light intensity;

b. ramping down the load to the minimum light intensity;

c. ramping up the load to the maximum light intensity; and d. ramping down the load to the new high-end trim value selected by the user.

* * * * *